US007631772B2

(12) United States Patent
Lafleur

(10) Patent No.: US 7,631,772 B2
(45) Date of Patent: Dec. 15, 2009

(54) CHILDPROOF KNIFE SUPPORT

(75) Inventor: Andre Lafleur, Boucherville (CA)

(73) Assignee: Atlantic Promotions Inc., Longueuil (CA)

( * ) Notice: Subject to any disclaimer, the term of this patent is extended or adjusted under 35 U.S.C. 154(b) by 0 days.

(21) Appl. No.: 12/091,955

(22) PCT Filed: Nov. 8, 2005

(86) PCT No.: PCT/CA2005/001711

§ 371 (c)(1),
(2), (4) Date: Apr. 29, 2008

(87) PCT Pub. No.: WO2007/053925

PCT Pub. Date: May 18, 2007

(65) Prior Publication Data

US 2008/0276465 A1 Nov. 13, 2008

(51) Int. Cl.
*A47F 7/00* (2006.01)

(52) U.S. Cl. ..... 211/70.7; 30/298.4; 248/37.3

(58) Field of Classification Search ..... 248/37.3, 248/37.6; 211/70.7, 89.01, 69.1, 70.6, 162; 206/553, 379, 45.2; 30/138, 298.4, 151
See application file for complete search history.

(56) References Cited

U.S. PATENT DOCUMENTS 3,580,394 A * 5/1971 Elliot ..... 248/37.6
3,980,608 A 9/1976 Faltersack
4,604,836 A 8/1986 Huang et al.
4,787,582 A 11/1988 Geleziunas et al.
4,825,550 A 5/1989 Pace
4,866,845 A 9/1989 McEvily
5,245,756 A * 9/1993 Howell et al. ..... 30/298.4
5,494,176 A 2/1996 Zallo
5,655,672 A 8/1997 Stuchlik, III
5,996,237 A * 12/1999 Sanders ..... 33/42
6,371,312 B1 4/2002 Tsuchida et al.
6,374,496 B1 * 4/2002 Hsu ..... 30/162
6,375,016 B1 * 4/2002 Stuchlik, III ..... 211/70.7
6,439,403 B1 8/2002 Levsen
6,581,774 B1 6/2003 Galafassi et al.
6,619,487 B2 9/2003 Stuchlik, III (Continued)

FOREIGN PATENT DOCUMENTS

GB 2348388 10/2000
JP 10192174 7/1998
JP 10229947 9/1998
WO 2004093617 11/2004

*Primary Examiner*—Ramon O Ramirez
(74) *Attorney, Agent, or Firm*—Darby & Darby P.C.

(57) ABSTRACT

There is provided a childproof knife support for supporting at least one knife having a blade. The knife support is provided with a frame having a hole extending therein for receiving the blade of the knife. The support is also provided with a clamp mounted in the hole and having first and second adjacent jaws for clamping the blade inside the frame once the blade is introduced in the hole. The support also has a spring for urging the second jaw against the first jaw to prevent a movement of the blade away from the hole by clamping the blade. The support also has a releasing mechanism preventing an action of the spring on the second jaw, thereby allowing the movement of the blade away from the hole.

28 Claims, 23 Drawing Sheets

U.S. PATENT DOCUMENTS

| | | | | |
|---|---|---|---|---|
| D488,677 | S | 4/2004 | Reichenbach et al. | |
| 2003/0000902 | A1 | 1/2003 | Keis et al. | |
| 2003/0038098 | A1 | 2/2003 | Stuchlik | |
| 2004/0031769 | A1 | 2/2004 | Schultz | |
| 2007/0278165 | A1* | 12/2007 | Ranieri | 211/70.7 |
| 2008/0173772 | A1* | 7/2008 | Welch | 248/37.3 |

* cited by examiner

CHILDPROOF KNIFE SUPPORT

CROSS REFERENCE TO PRIOR APPLICATION

This application is the U.S. national phase of International Application No. PCT/CA2005/001711, filed Nov.8, 2005.The disclosure of which is incorporated herein by reference in its entirety.

FIELD OF THE INVENTION

The present invention generally relates to a knife support for supporting at least one knife and more particularly concerns a childproof knife support provided with safety locks that prevent the knives from being removed from the knife support, thereby providing a secure and practical use thereof.

BACKGROUND OF THE INVENTION

Knife holders for holding a plurality of knives, typically in the form of wooden blocks having a plurality of slots, are well known. The most common form of these knife holding blocks is designed to be placed on a countertop so that the knives will be readily accessible. Since the knives are readily accessible, it is desirable to include some type of locking mechanism to prevent the knives from being removed from the block, for example, by young children.

Known in the art, there is U.S. design Pat. No. D488,677 granted to Reichenbach et al., which discloses a locking block for knives. The block has a set of slots, each for respectively receiving a blade of a knife. The block is also provided with a locking system comprising a rotatable locking element having a first position preventing a movement of each of the knives away from the block, and a second position where each of the knives can be removed from the block. However, this block requires the use of knives having a predetermined shaped handle having a recess near the blade. In the first position, the locking element extends in the recess of each handle to prevent the knives from being pulled out of the block.

Also known in the art, there is U.S. Pat. No. 5,245,756 granted to Howell et al., which discloses a lockable knife block in which a separate spring-loaded locking and latching device is provided for each of the slots in the knife block. Each of the devices engages a notch formed in the upper portion of the blade of a corresponding knife to prevent each of the knives from being removed from the knife block. A push button release mechanism is attached to each locking and latching device for disengaging the knife blade latched thereto. While effective, the knife block is large and bulky, and a large amount of hardware is required in order to lock all of the knives in the knife holder because a separate locking device is required for each knife.

Also known in the art, there is U.S. Pat. No. 6,375,016 granted to Stuchlik, which discloses a knife holder with safety lock capable of preventing a movement of the knives away from the holder. This knife holder also requires the use of particularly shaped knives having a recess in their blade for interacting with the safety lock.

Also known in the art, there is US patent application No. 2004/0031769. In this patent application, Schultz describes a holding device for knives. This holding device can be provided with a locking device having a first position preventing a movement of each of the knives away from the holding device, and a second position where each of the knives can be removed from the holding device. However, this device also requires the use of knives having a predetermined shaped handle having a recess near the blade. In the first position, the locking device cooperates with each recess of each knife to prevent movement of the knives away from the holding device.

Also of interest, there is U.S. Pat. No. 4,787,582, granted to Geleziunas, which discloses a device for holding planar implements such as knives. This device is provided with a number of vertical slots. For each slot, there is a number of gripping elements and a spring urging the gripping elements into the slot, for grasping a knife. Each gripping element is preferably channel-shaped and includes flanges projecting through openings of a side wall of a slot. The gripping elements define a tapered entry zone, so that a knife can be inserted simply by pushing it into a slot. This device is however not provided with locking means preventing a movement of the knives away from the device.

Also known in the art, there are the following patents and patent applications which describe different knife holding devices: U.S. Pat. Nos. 3,980,608; 4,604,836; 4,825,550; 4,866,845; 5,494,176; 5,655,672; 6,371,312; 6,439,403; 6,581,774 and 6,619,487 and US patent applications Nos. 2003/0000902 and 2003/0038098.

None of the above-mentioned patents provides a convenient knife support which can be easily and safely locked to prevent the removal of the knives when required, while being conveniently adapted to support any conventional knife without requiring a particular shape of the knife to be supported.

Furthermore, none of the above-mentioned patents provides a knife support which is effectively childproof since the proposed locking mechanisms could be easily operated by a child.

SUMMARY OF THE INVENTION

It is an object of the present invention to provide a childproof knife support that satisfies the above-mentioned needs.

Accordingly, there is provided a childproof knife support for supporting at least one knife having a blade. The knife support is provided with a frame having a hole extending therein for receiving the blade of the knife. The childproof knife support also has a clamp mounted in the hole and having first and second adjacent jaws for clamping the blade inside the frame once the blade is introduced in the hole. The first jaw is mounted in a fixed manner in the hole and the second jaw is movably mounted with respect to the frame. The knife support is also provided with a spring for urging the second jaw against the first jaw to prevent a movement of the blade away from the hole by clamping the blade. The knife support also has a releasing mechanism preventing an action of the spring on the second jaw, thereby allowing the movement of the blade away from the hole.

BRIEF DESCRIPTION OF THE DRAWINGS

A detailed description of preferred embodiments will be given hereinbelow with reference to the following drawings, in which like numbers refer to like elements.

Figure 1:
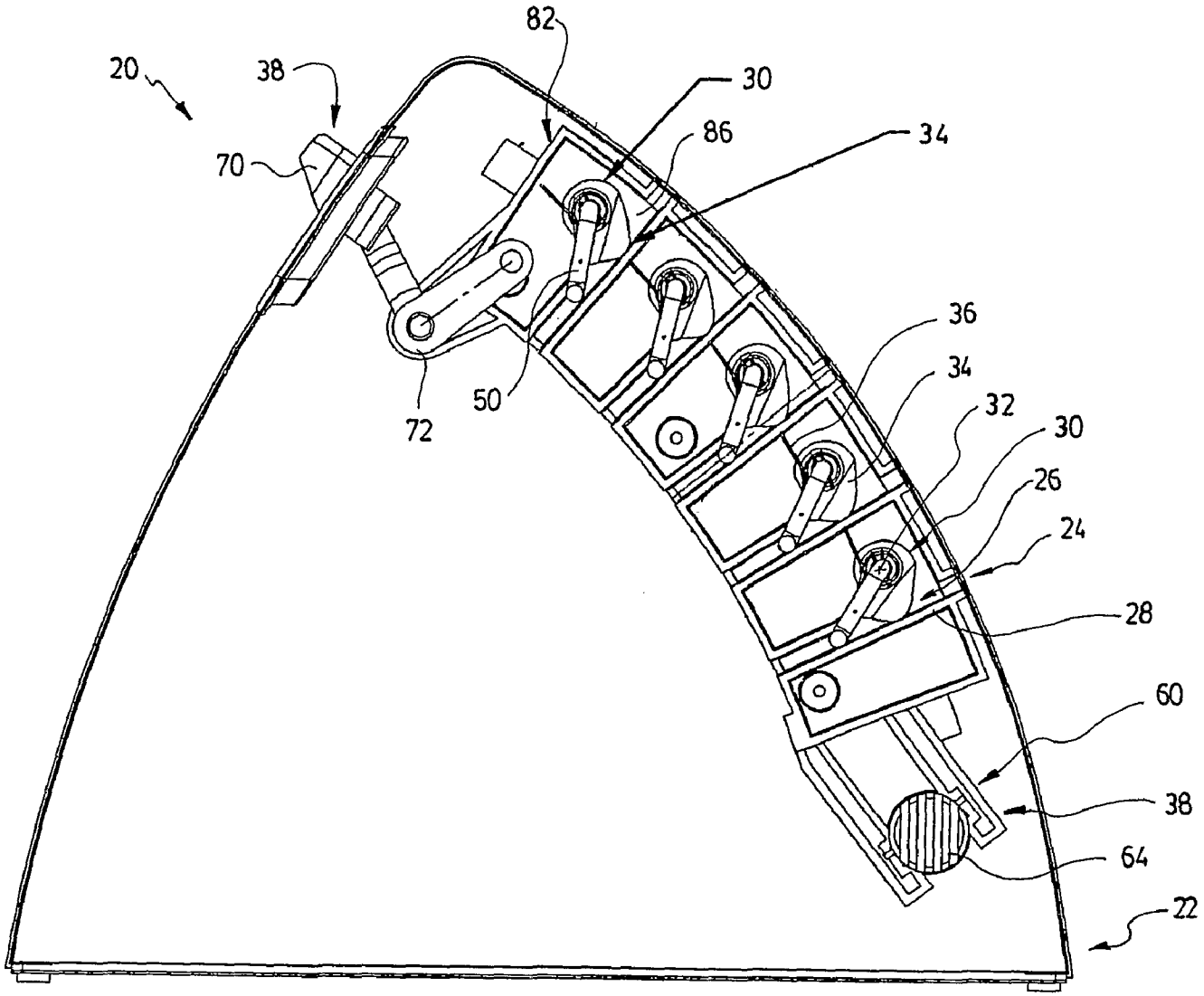
FIG. 1 is a cross-sectional side view of a childproof knife support in a first position according to the present invention.

The objects, advantages and other features of the present invention would become more apparent upon reading of the following non-restricted description of preferred embodiments thereof, given for the purpose of exemplification only with reference to the accompanying drawings.

DETAILED DESCRIPTION OF THE PREFERRED EMBODIMENTS

In the following description, similar features in the drawings have been given similar reference numerals and in order to weight down the figures, some elements are not referred to in some figures if they were already identified in a precedent figure.

The present invention concerns a childproof knife support which can advantageously be used with any conventional knife, without requiring a particular shape of the knife. Thus, the childproof knife support of the present invention is particularly advantageous over the knife supports proposed in the prior art, since the knife support and the knives do not require to be adapted to each other, and therefore can be changed independently. Moreover, in a preferred embodiment of the childproof knife support of the present invention which will be described in details thereinafter, the releasing mechanism preferably requires the use of the two hands of the user for better preventing removing of the knives from the support by a child while remaining easily operable. Furthermore, the knife support of the present invention is advantageously compact and simple to construct.

Referring to FIGS. 1 to 5D, there is shown a childproof knife support 20 for supporting at least one knife having a blade (not shown), according to the present invention. As best illustrated on FIG. 5A, the childproof knife support 20 is provided with a frame 22 having a hole 24 extending therein for receiving the lo blade of the knife. Obviously, and as illustrated, the frame 22 can be provided with a plurality of holes 24, each for respectively receiving the blade of a corresponding knife.

Referring now to FIGS. 9A, 9B, 10A to 10D and more particularly to FIGS. 8A to 8D, the frame 22 of the knife support 20 of the present invention may further advantageously be provided with a casing 80 mounted therein. Preferably, the casing 80 comprises a right and a left case 82, 84 mountable together inside the frame 22. As can be seen, each of the cases 82, 84 may be provided with a plurality of compartments 86, each being advantageously aligned with a corresponding hole 24 and receiving a clamp 26 therein, as it will be described thereinafter. The casing 80 is preferably made of plastic but obviously any other convenient material could be used.

Figure 6:
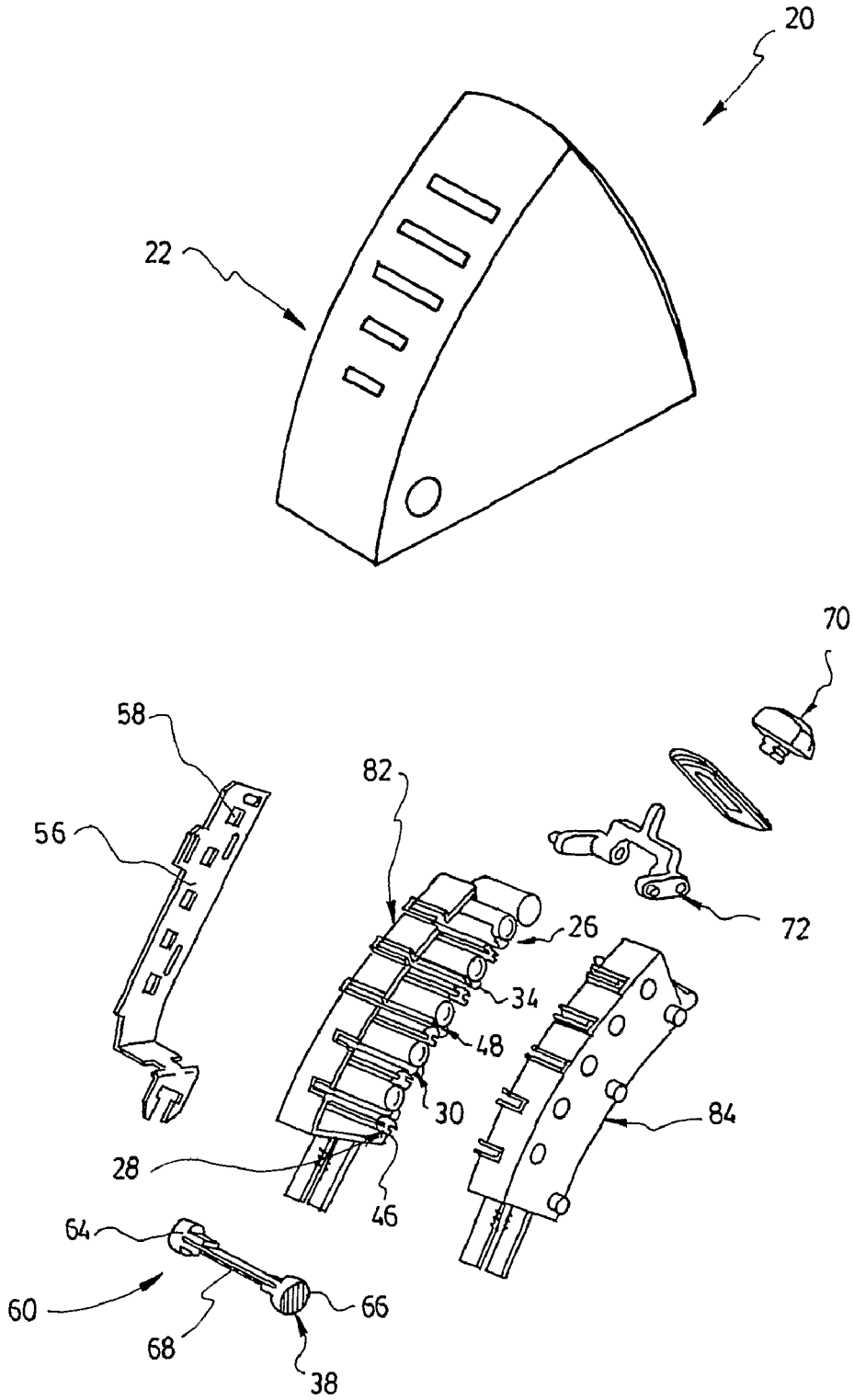
FIG. 6 is an exploded view of the childproof knife support of FIG. 5A.
Figure 7A:
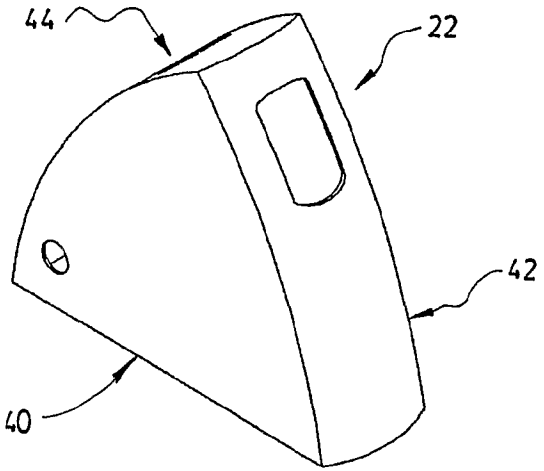
FIG. 7A is a perspective view of the frame of the childproof knife support of FIG. 5A.
Figure 7D:
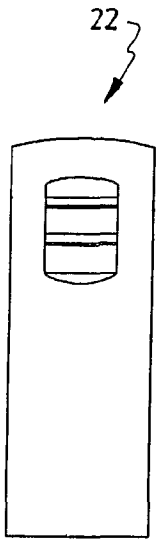
FIG. 7D is a front view of the frame of FIG. 7A.
Figure 7E:
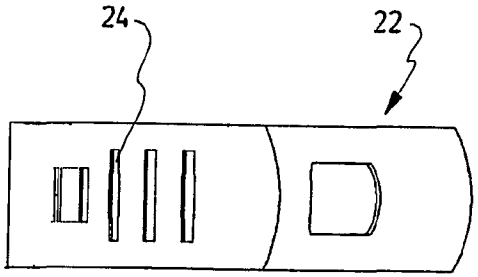
FIG. 7E is a top view of the frame of FIG. 7A.
Figure 7B:
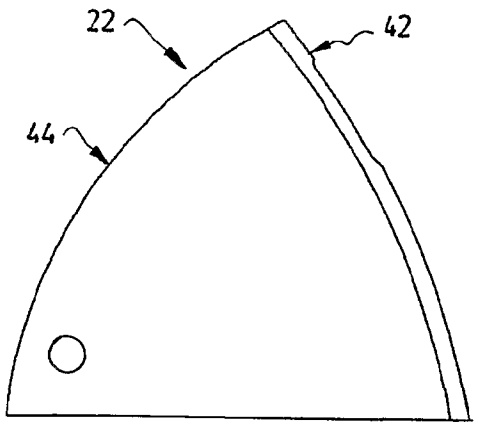
FIG. 7B is a side view of the frame of FIG. 7A.
Figure 7C:
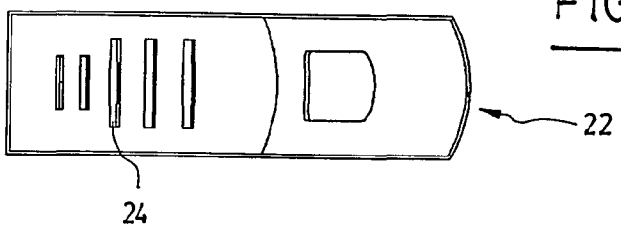
FIG. 7C is a bottom view of the frame of FIG. 7A.
Figure 8A:
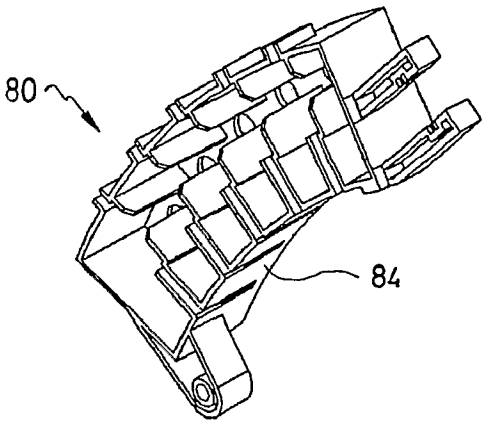
FIG. 8A is a perspective view of a left case of the knife support of FIG. 5A.
Figure 8C:
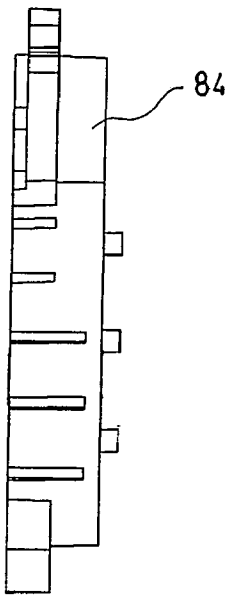
FIG. 8C is a front view of the left case of FIG. 8A.
Figure 8D:
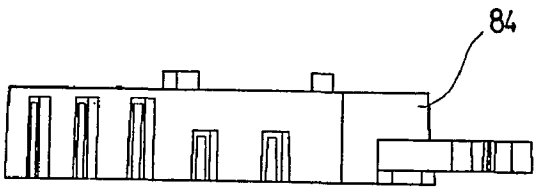
FIG. 8D is a top view of the left case of FIG. 8A.
Figure 8B:
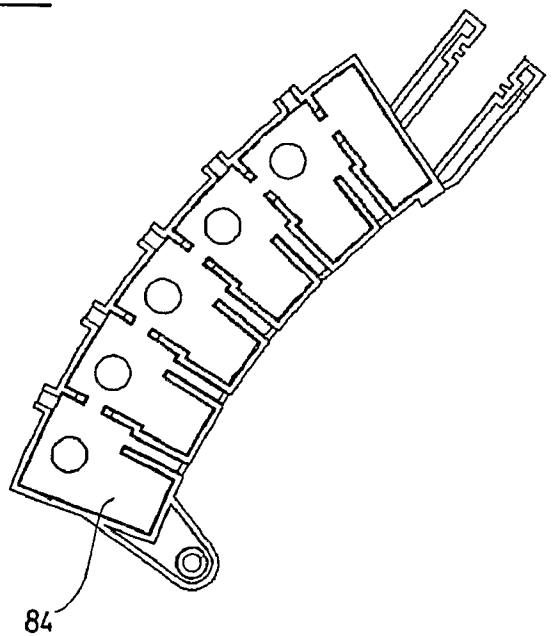
FIG. 8B is a side view of the left case of FIG. 8A.
Figure 9A:
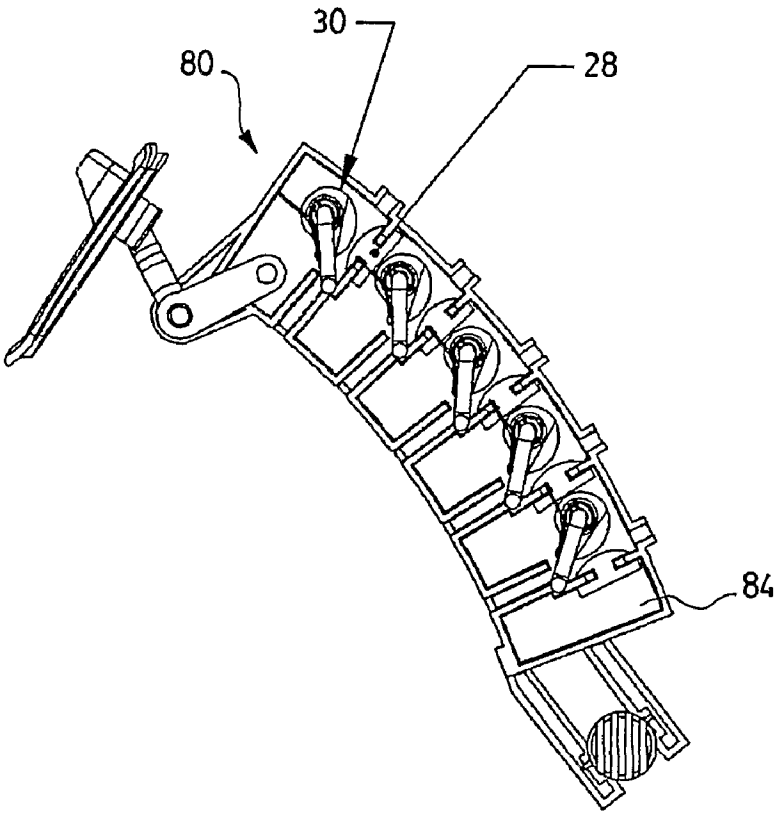
FIG. 9A is a partial side view of the knife support of FIG. 5A.
Figure 9B:
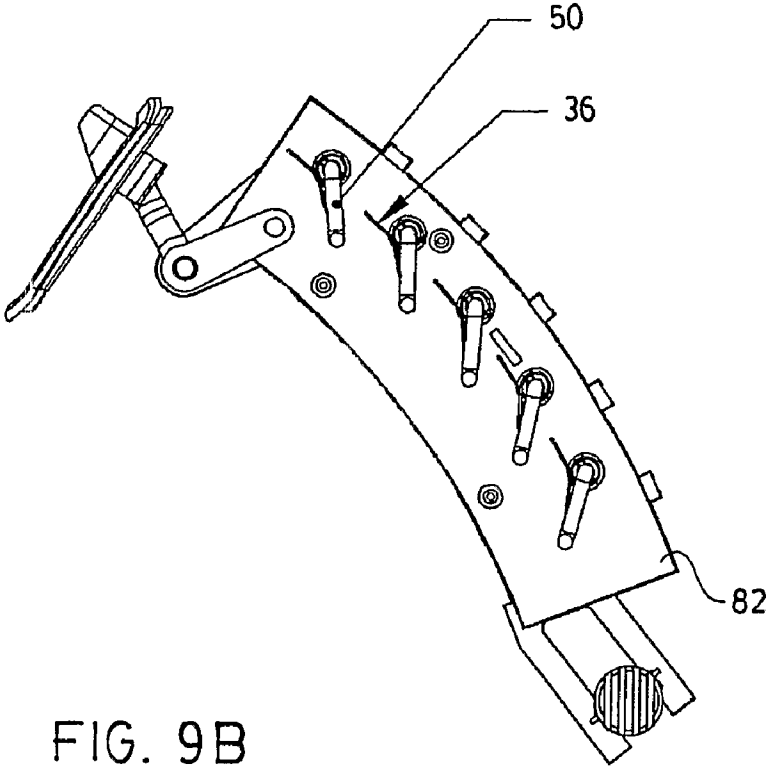
FIG. 9B is another partial side view of the knife support of FIG. 5A.
Figure 10D:
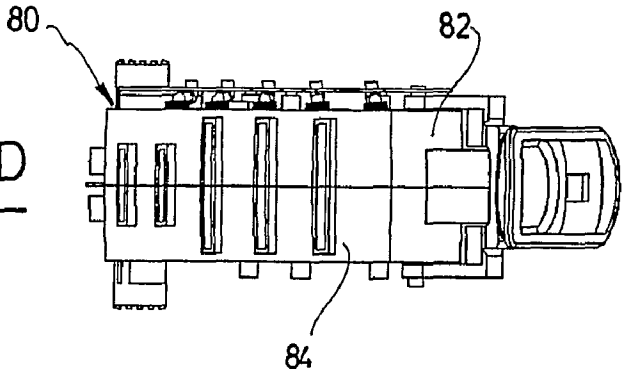
FIG. 10D is a top view of FIG. 10A.
Figure 10B:
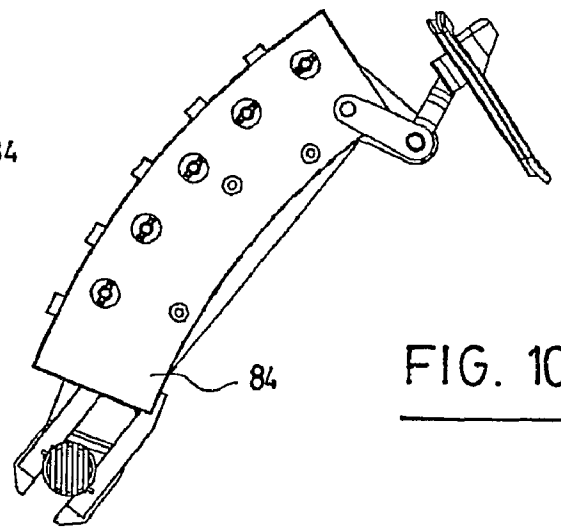
FIG. 10B is a side view of FIG. 10A.
Figure 10A:
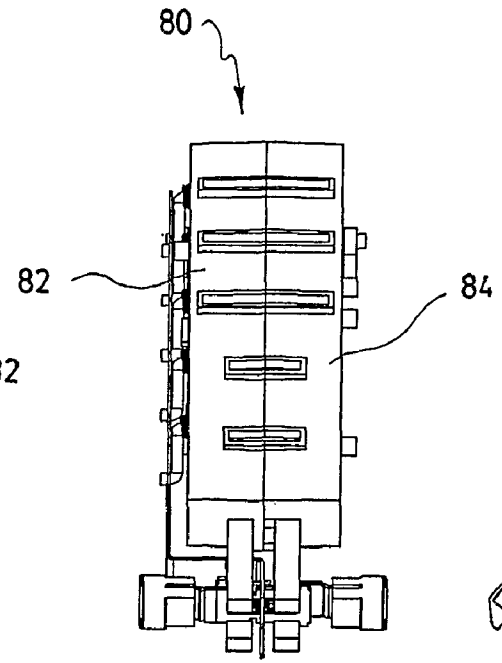
FIG. 10A is a partial front view of the knife support of FIG. 5A.
Figure 10C:
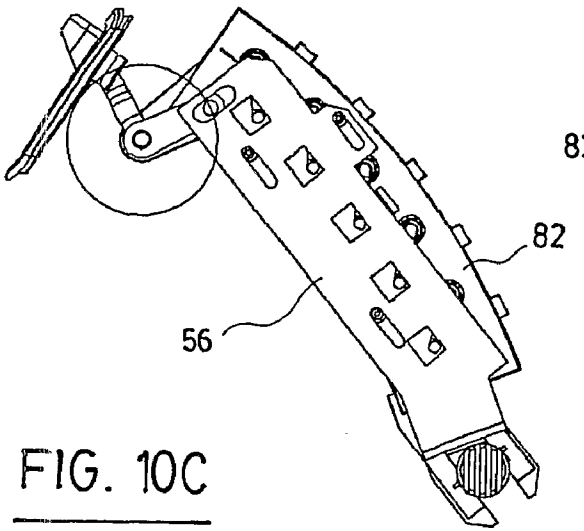
FIG. 10C is another side view of FIG. 10A.

Referring again to FIGS. 1 to 4 and also to FIG. 6, the childproof knife support 20 also has a clamp 26 mounted in the hole 24, preferably inside a compartment 86 of the casing 80. The clamp 26 has first and second adjacent jaws 28, 30 for clamping the blade inside the cases 82, 84 of the frame 22 once the blade is introduced in the hole 24. The first jaw 28 is mounted in a fixed manner in the hole 24 and the second jaw 30 is movably mounted with respect to the cases 82, 84 of the frame 22. In this illustrated embodiment, the second jaw 30 is preferably pivotally mounted on a pivot axis 32 with respect to the frame, and more preferably has an eccentric portion 34. The knife support 20 is also provided with a spring 36 for urging the second jaw 30 against the first jaw 28 to prevent, preferably with the aid of the eccentric portion 34, a movement of the blade away from the hole 24 by clamping the blade. The knife support 20 also has a releasing mechanism 38 preventing an action of the spring 36 on the second jaw 30, thereby allowing the movement of the blade away from the hole 24.

Referring again to FIGS. 5A to 5D and also to FIGS. 7A to 7E, in side view, the frame 22 preferably has a shape of a quarter of a circle for angularly supporting the knives therein. In other words, in side view, the frame 22 preferably has a flat bottom wall 40, a substantially rounded vertical side wall 42 and a rounded wall 44 extending between the bottom and side walls 40, 42. Preferably, the holes 24 extend in the rounded wall 44. In this case, the cases 82, 84 may also advantageously have a rounded wall extending along the rounded wall 44. Moreover, as illustrated, the holes 24 preferably extend in a horizontal manner in the frame 22 and the frame 22 can advantageously be provided with elongated holes 24 of different lengths for accommodating several sizes of knives. Furthermore, it is worth mentioning that the knife support 20 of the present invention is adapted to support several size of knife in the same hole 24. In other words, an elongated hole 24 can advantageously receive and clamp a knife having a smaller size than the hole 24. With this particularly shaped frame 22, it is possible to provide a compact assembly. However, any convenient shape for the frame 22 could also be envisaged without departing from the scope of the present invention. Furthermore, the frame 22 is preferably made of wood, but it should be understood that the frame could also be made of any other convenient material such as aluminum or plastic as non-limitative examples.

Figure 11A:
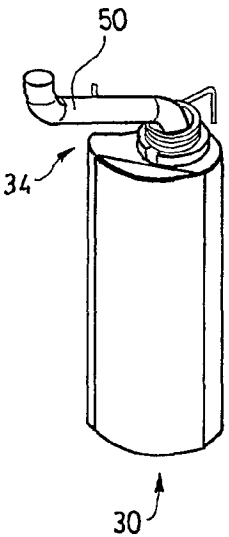
FIG. 11A is a perspective view of a second jaw of a clamp according to the invention.
Figure 11B:
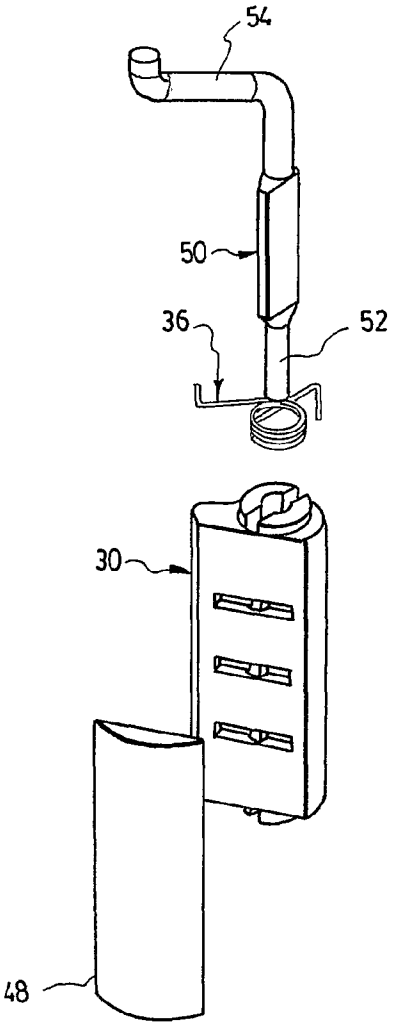
FIG. 11B is an exploded perspective view of the second jaw of FIG. 11A.
Figure 11C:
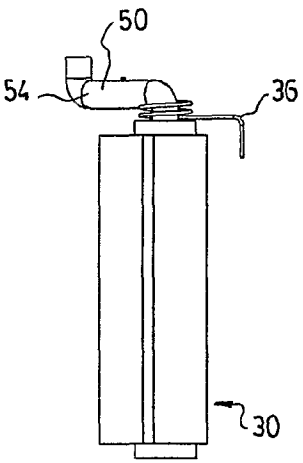
FIG. 11C is a top view of the second jaw of FIG. 11A.
Figure 11D:
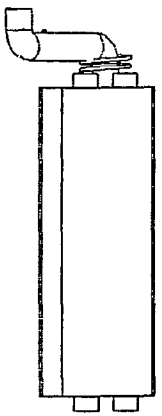
FIG. 11D is a front view of the second jaw of FIG. 11A.
Figure 11E:
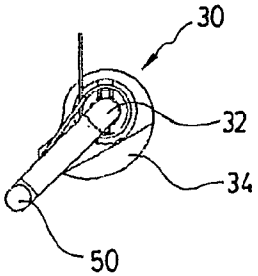
FIG. 11E is a side view of the second jaw of FIG. 11A.
Figure 12A:
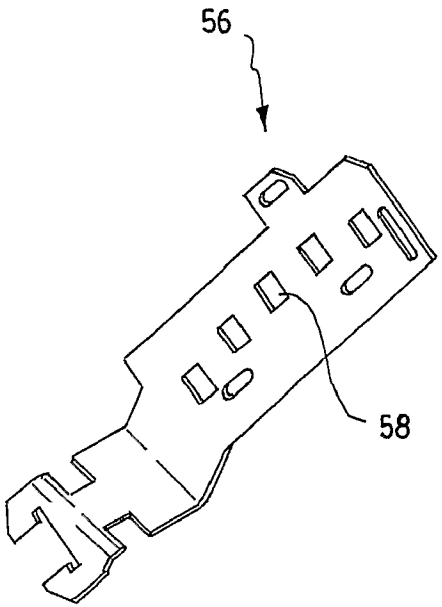
FIG. 12A is a perspective view of a plate of a releasing mechanism according to the present invention.
Figure 12C:
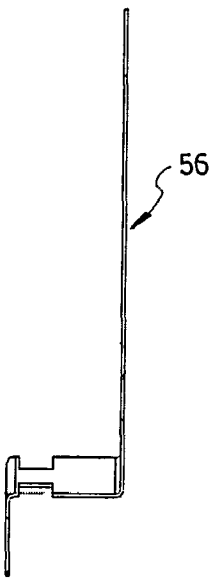
FIG. 12C is a side view of the plate of FIG. 12A.
Figure 12B:
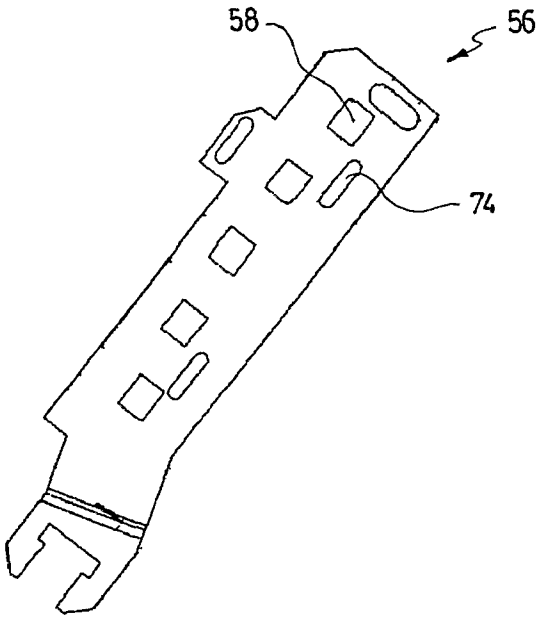
FIG. 12B is a front view of the plate of FIG. 12A.
Figure 12D:
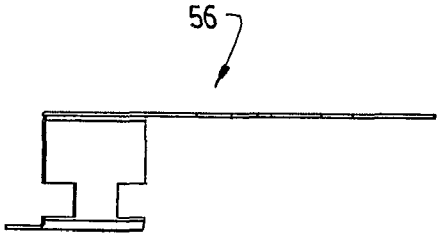
FIG. 12D is a top view of the plate of FIG. 12A.
Figure 13A:
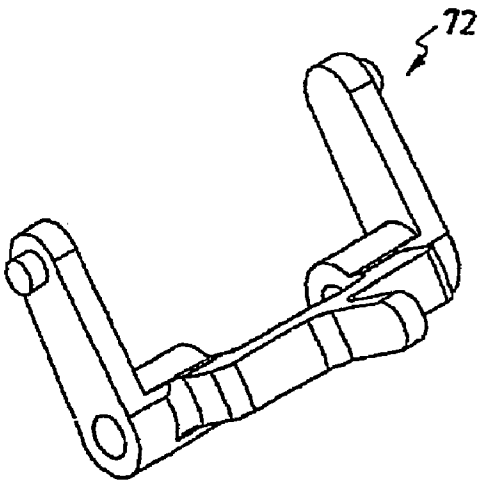
FIG. 13A is a perspective view of a swivel of a releasing mechanism according to the present invention.
Figure 13B:
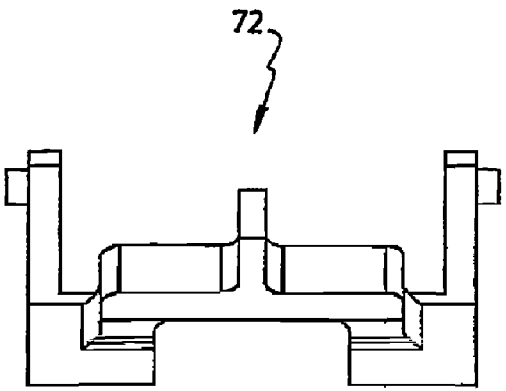
FIG. 13B is a front view of the swivel of FIG. 13A.
Figure 13C:
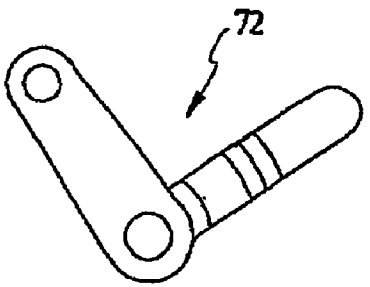
FIG. 13C is a side view of the swivel of FIG. 13A.
Figure 13D:
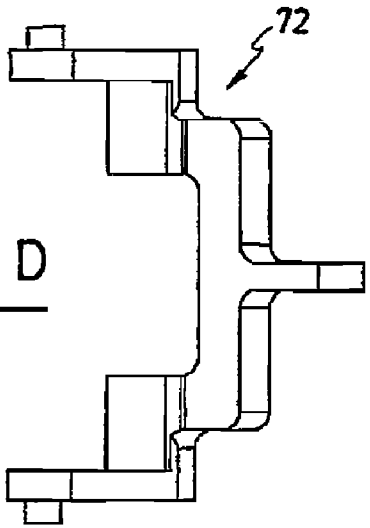
FIG. 13D is a top view of the swivel of FIG. 13A.
Figure 14A:
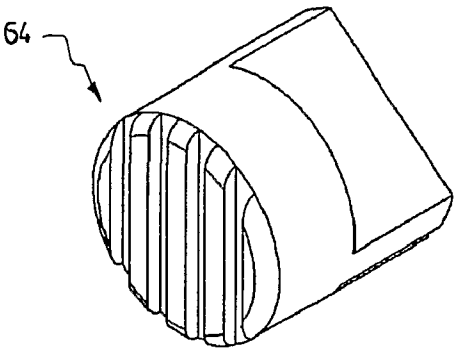
FIG. 14A is a perspective view of a push button of a releasing mechanism according to the present invention.
Figure 14D:
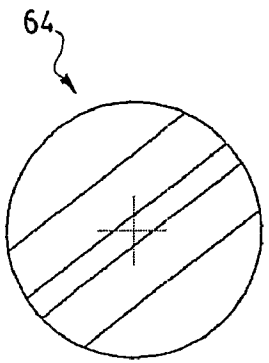
FIG. 14D is a rear view of the push button shown in FIG. 14A.
Figure 14C:
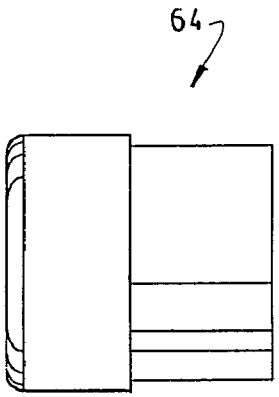
FIG. 14C is a side view of the push button shown in FIG. 14A.
Figure 14E:
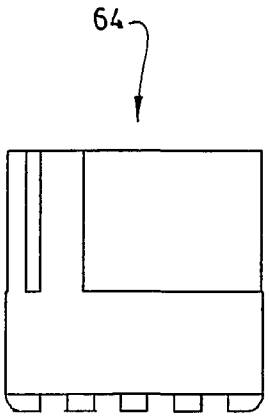
FIG. 14E is a top view of the push button shown in FIG. 14A.
Figure 14B:
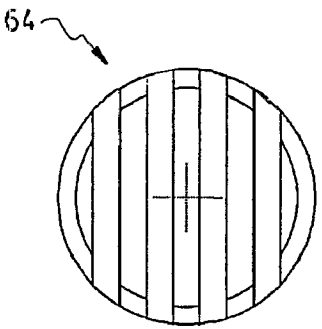
FIG. 14B is a front view of the push button shown in FIG. 14A.
Figure 15A:
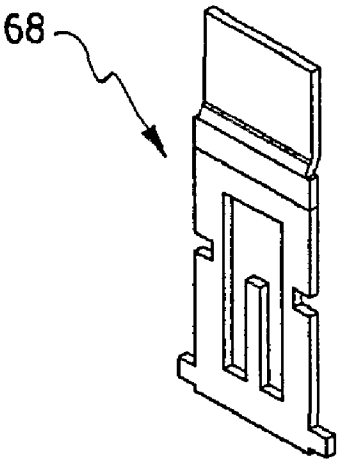
FIG. 15A is a perspective view of a locking element of a releasing mechanism according to the present invention.
Figure 15D:
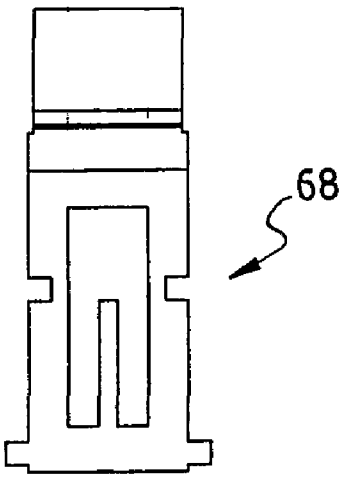
FIG. 15D is a rear view of the locking element of FIG. 15A.
Figure 15B:
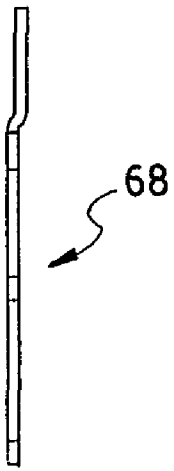
FIG. 15B is a side view of the locking element of FIG. 15A.
Figure 15E:
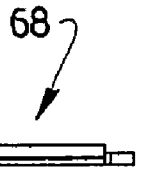
FIG. 15E is a top view of the locking element of FIG. 15A.
Figure 15C:
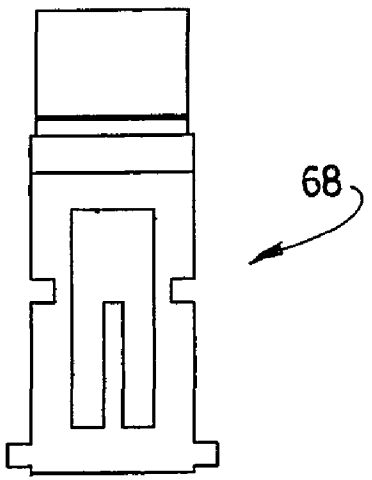
FIG. 15C is a front view of the locking element of FIG. 15A.
Figure 16:
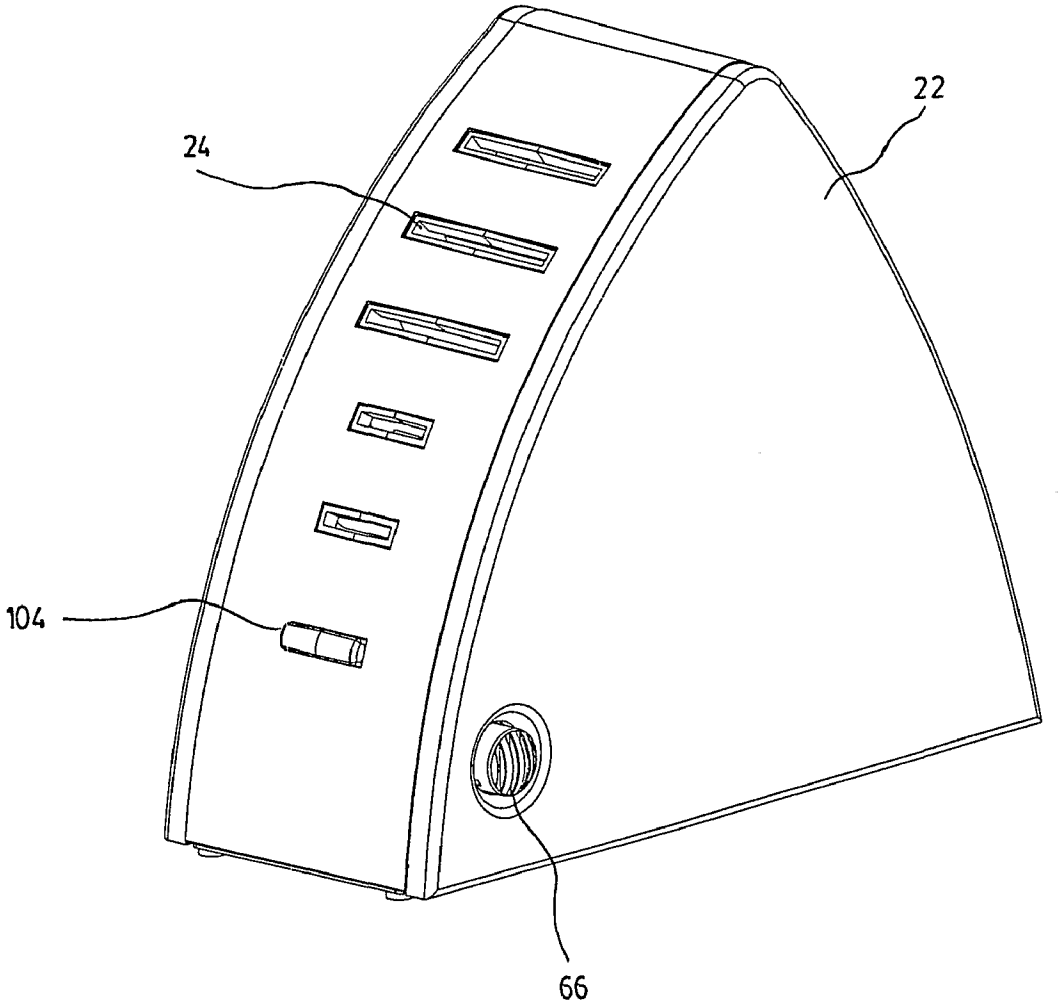
FIG. 16 is a perspective view of another embodiment of the childproof knife support according to the present invention.

Referring now to FIG. 6 and also to FIG. 1, the first jaw 28 of the clamp 26 preferably comprises a rubber wall 46, which is more preferably a rubber extrusion. Moreover, the second jaw 30 is also preferably provided with a rubber portion. In a further preferred embodiment, the eccentric portion 34 of the second jaw 30 is also preferably provided with a rubber portion 48 and more preferably has a rounded shape, even if other convenient shapes could also be envisaged. Even more preferably, the rubber portion 48 is obtained by an overmolding process. This particular preferred embodiment allows to provide a smooth contact of the clamp 26 with the blade of the knife without damaging the blade nor the clamp 26 during the insertion and the removal of the knife. Moreover, it also allows to self lock the knife in the knife support 20 even if the knife is pulled out of the support. According to another preferred embodiment, the rubber portion 48 can also be co-injected. It should also be mentioned that the rubber portion 48 can be mechanically or chemically attached to the second jaw 30. Also preferably, the pivot axis 32 around which the second jaw 30 pivots is advantageously off-centered in opposite direction with respect to the eccentric portion 34, as better illustrated on FIGS. 1 and 11E.

With reference now to FIGS. 11A to 11E and again to FIG. 1, in a further preferred embodiment, the childproof knife support of the present invention may preferably further comprise a shaped rod 50. The shaped rod 50 preferably has a first end 52 extending inside the second jaw 30 along the pivot axis 32, and a second shaped end 54 protruding from the second jaw 30. The rod 50 is preferably solid with the second jaw 30 while the spring 36 is preferably a torsion spring mounted between the frame 22 and the second end 54 of the rod 50 for urging the second jaw 30 against the first jaw 28.

Referring now to FIGS. 3, 4, 6 and 12A to 12D, the releasing mechanism 38 is preferably provided with a plate 56 slidably mounted to the case 82 of the frame 22. As shown, the plate 56 is preferably provided with elongated slots 74. In this case, the plate 56 is slidably connected to the case 82 of the frame 22 with attaches 78 attached to the case 82 through a corresponding elongated slot 74. The plate 56 advantageously has an aperture 58 for receiving the second end 54 of the rod 50 therethrough. The plate 56 is slidable between a first position illustrated in FIG. 3 where the second end 54 of the rod 50 is able to move freely within the aperture 58 of the plate 56, and a second position illustrated in FIG. 4 where the second end 54 is moved against the action of the torsion spring 36, thereby allowing the movement of the blade away from the hole 24 of the frame 22.

Figure 2:
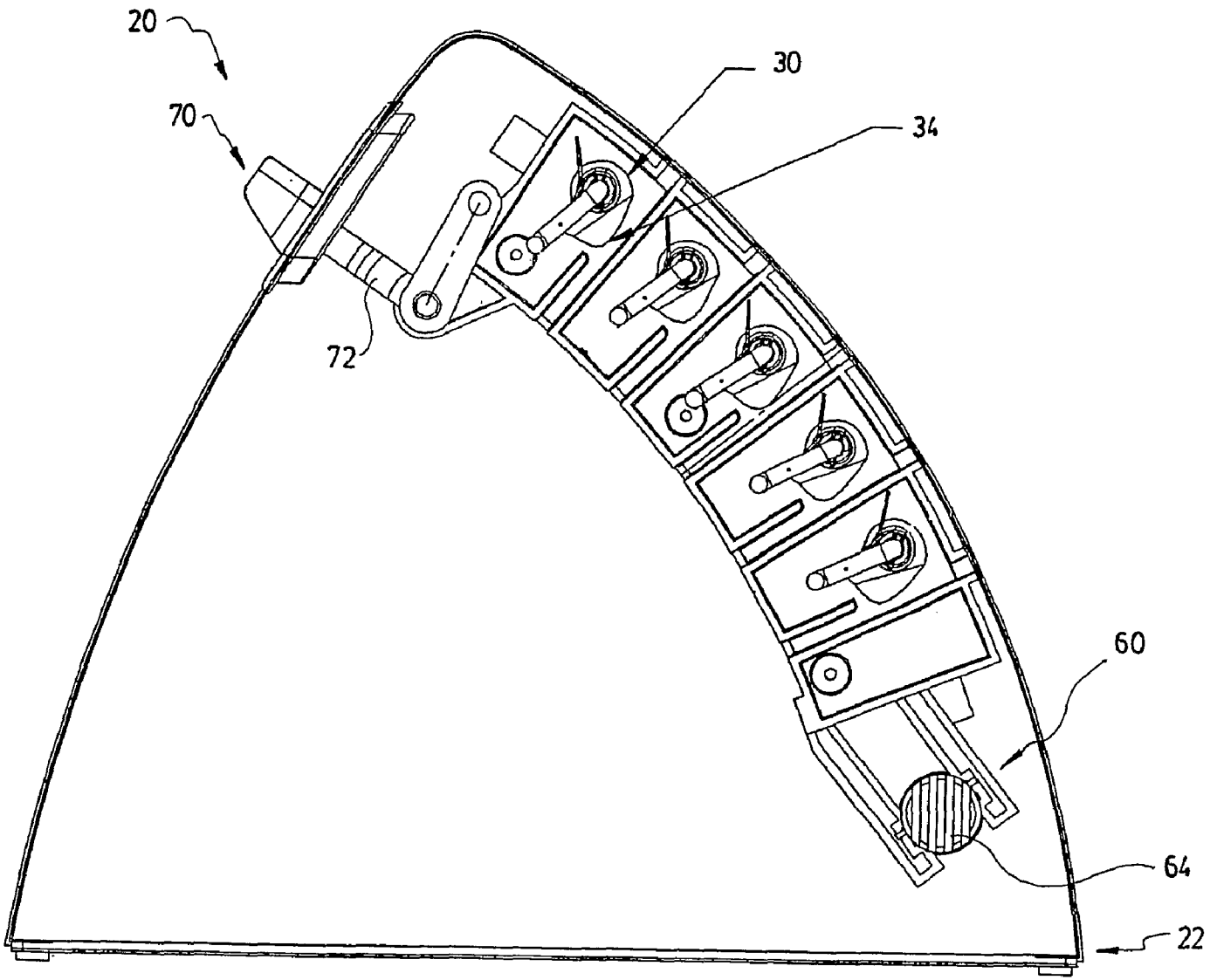
FIG. 2 is a cross-sectional side view of the childproof knife support of FIG. 1 in a second position.
Figure 3:
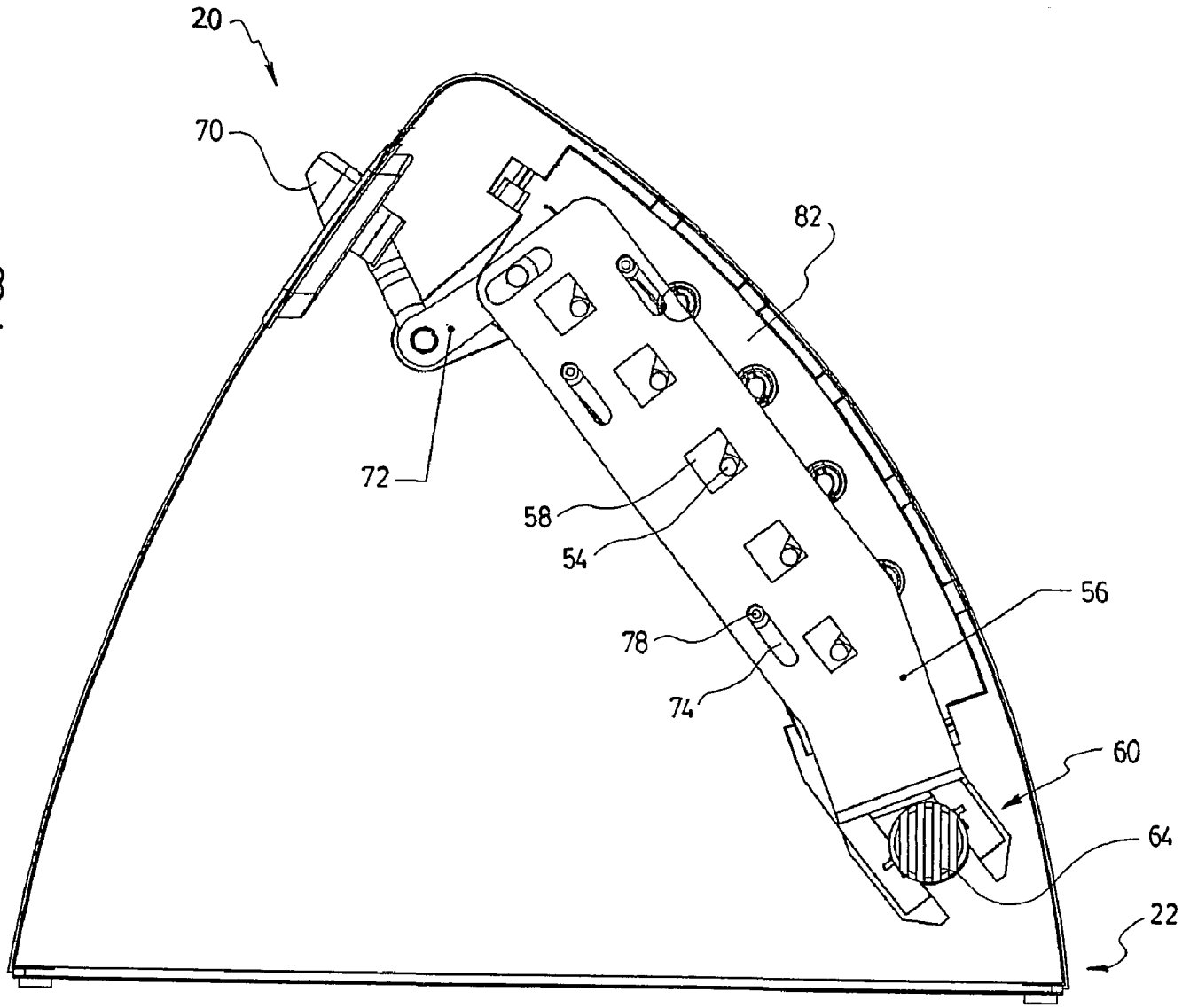
FIG. 3 is another cross-sectional side view of the childproof knife support of FIG. 1 in the first position.
Figure 4:
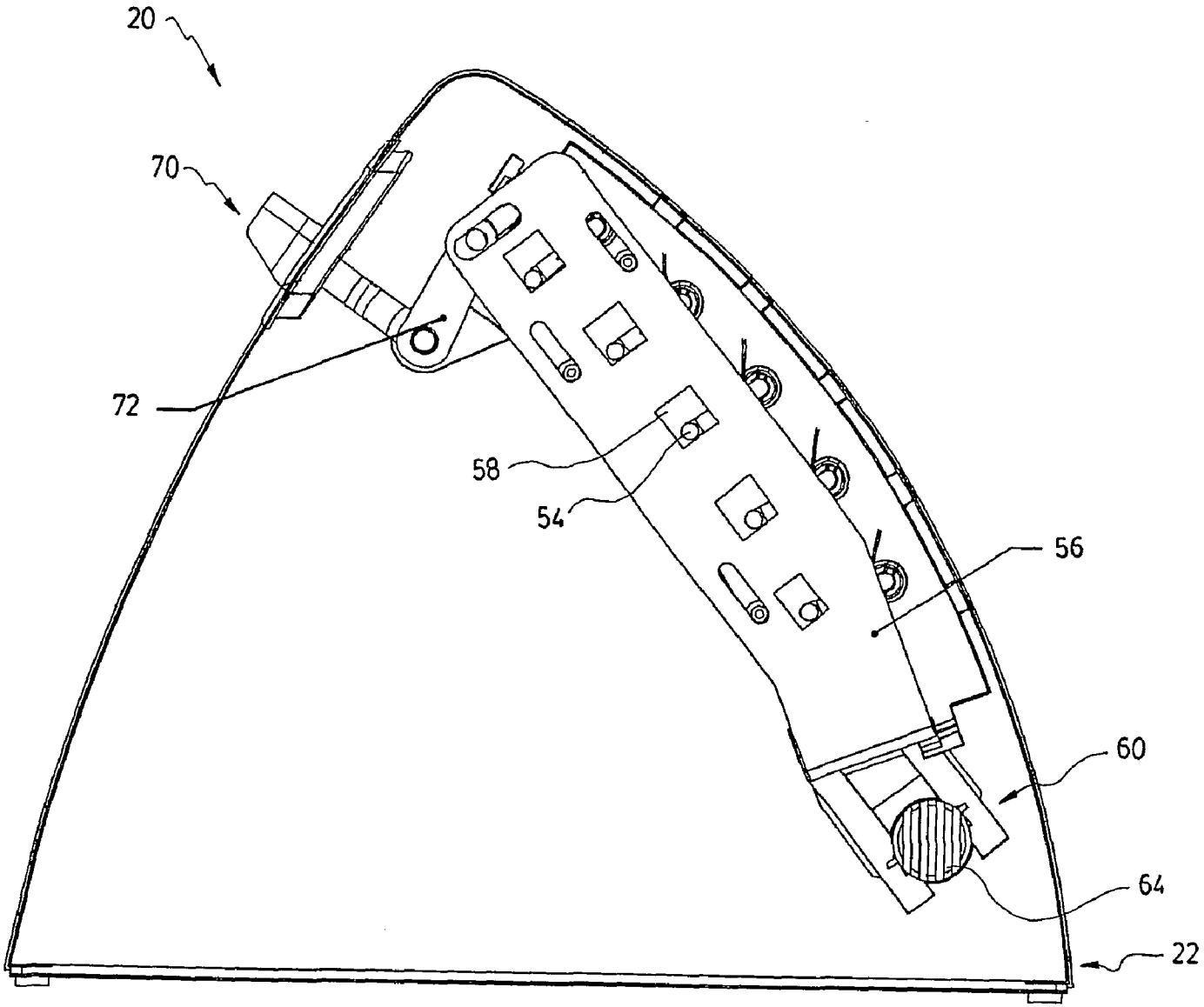
FIG. 4 is another cross-sectional side view of the childproof knife support of FIG. 1 in the second position.
Figure 5A:
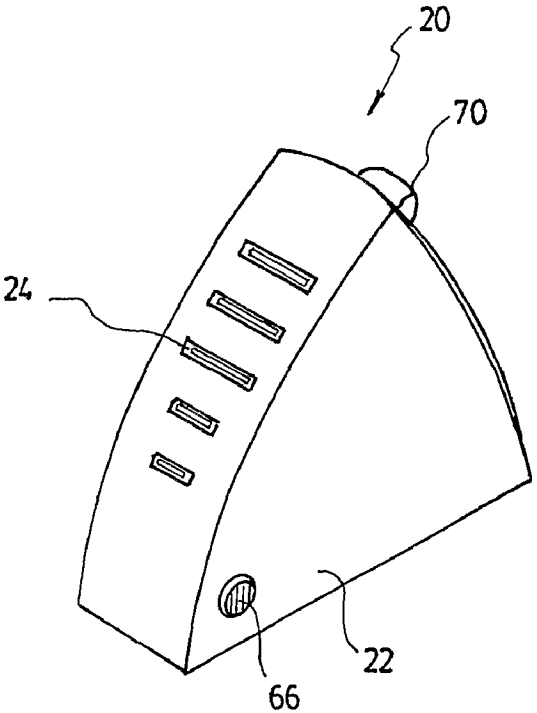
FIG. 5A is a perspective view of a childproof knife support according to the present invention.
Figure 5D:
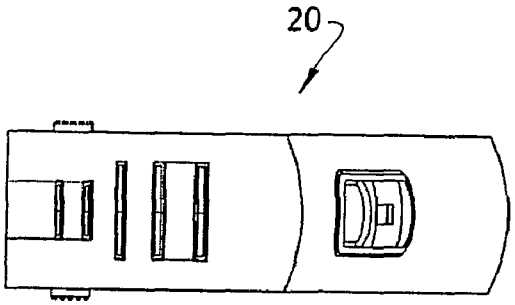
FIG. 5D is a top view of the childproof knife support of FIG. 5A.
Figure 5B:
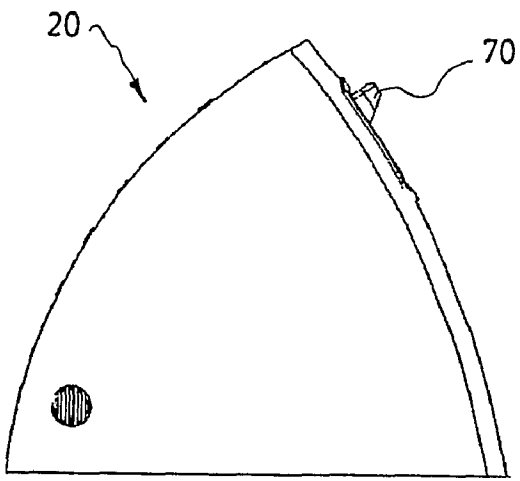
FIG. 5B is a side view of the childproof knife support of FIG. 5A.
Figure 5C:
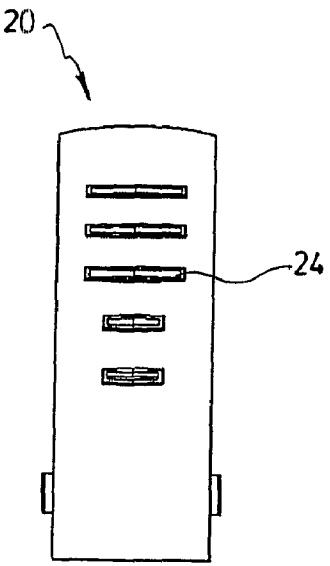
FIG. 5C is a front view of the childproof knife support of FIG. 5A.

Referring now to FIGS. 1 and 3, which show the plate 56 in the first lo position, and also to FIGS. 2 and 4, which show the plate 56 in the second position, the releasing mechanism 38 is also preferably provided with a locking mechanism 60 operatively connected to the plate 56 for locking the plate 56 in the first position. This locking mechanism 60 is advantageously accessible to a user to unlock the plate 56. The releasing mechanism 38 also preferably has a moving mechanism operatively connected to the plate 56. The moving mechanism is also advantageously accessible to a user for sliding the plate 56 in the second position when the locking mechanism 60 is unlocked to release the knives, thereby allowing the user to pull any of the knives out of the casing 80 of the frame 22.

Still referring to FIGS. 1 to 4, and also to FIGS. 6, the locking mechanism 60 can advantageously be provided with a first and a second push button 64, 66 extending on the frame 22, preferably at the bottom of the frame, and interconnected together through a locking element 68 interacting with the plate 56. Preferably, each of the push buttons 64, 66 respectively extends on a respective side of the frame 22. FIGS. 14A to 14E illustrate a push button 64 which can advantageously be used while FIGS. 15A to 15E illustrate a locking element 68 which can advantageously be used, but it should be understood that any other convenient arrangement adapted to lock the plate 56 in the first position could also be envisaged. With this particular embodiment, an action of the user on each of the push buttons 64, 66 unlocks the plate 56 from the locking element 68.

Still referring to FIGS. 1 to 4 and 6, and also to FIG. 13A to 13D, the moving mechanism may advantageously have a sliding button 70 extending on the frame 22 distal from the push buttons 64, 66, preferably on the top of the frame 22. In this preferred illustrated embodiment, the moving mechanism advantageously further has a swivel 72 connected to each of the sliding button 70 and the plate 56 for sliding the plate 56 in the second position when the locking mechanism 60 is unlocked. Thus, when a user wants to use a knife which is secured in the knife support 20 of the present invention, he firstly has to operate the first and the second push buttons 64, 66 with a first hand to release the plate 56. When the plate 56 is released, the user then has to slide the sliding button 70 with his second hand. This operation drives a pivotal movement of the swivel 72 which drives a sliding of the plate 56 in the second position. Once the sliding button 70 has been operated, the plate 56 extends in the second position and the user can then stop his action on the first and second push buttons 64, 66 and use his first hand to pull one or more knives out of the knife support 20. When the user releases the sliding button 70, the plate 56 then slides back in the first position and locks itself with the locking element 68 of the locking mechanism 60. At that time, the knives remaining in the knife support 20 are then locked again until the user performs the same above-described operation. This particular preferred arrangement thus provides an efficient childproof releasing mechanism while providing a convenient use thereof. Of course, it is worth mentioning that any other convenient releasing means could also be used and are believed to be within the scope of the present invention. It should also be mentioned that the sliding button 70 and the push buttons 64, 66 extend preferably distal from each other, but other arrangements could also be envisaged. Nevertheless, the above-described preferred arrangement provides the advantage of remaining relatively easy to be operated while providing an effective childproof use. Furthermore, it could also be envisaged to provide a locking mechanism having an unlocked position. Thus, with this embodiment, the user could unlock the knives in order to use them freely, without having to unlock the mechanism every time he needs one of the knives. After he is finished with the support, he would then just have to disengage the unlocked position to activate the locking mechanism, thereby preventing the removal of the knives.

Still referring to FIGS. 1 to 4 and 6, and as already mentioned, the frame 22 can advantageously further have a plurality of holes 24 extending therein, each for respectively receiving the blade of a corresponding knife. In this case, the support 20 preferably further comprises a plurality of clamps 26, each being respectively mounted in a corresponding hole 24. The knife support 20 also preferably has a plurality of springs 36 for respectively urging the corresponding second jaw 30 of the corresponding clamp 26 against the corresponding first jaw 28. Moreover, the knife support 20 also preferably has a plurality of shaped rods 50, each being solid with the corresponding second jaw 30 of the corresponding clamp 26. Furthermore, the plate 56 of the releasing mechanism 38 preferably has a plurality of apertures 58 for respectively receiving the corresponding second end 54 of the corresponding rod 50 therethrough to allow the releasing mechanism 38 to prevent the action of each of the springs 36 on the corresponding second jaw 30. Thus, this preferred embodiment advantageously allows to support a plurality of knives which can be unlocked from the support with a single releasing mechanism.

Figure 18:
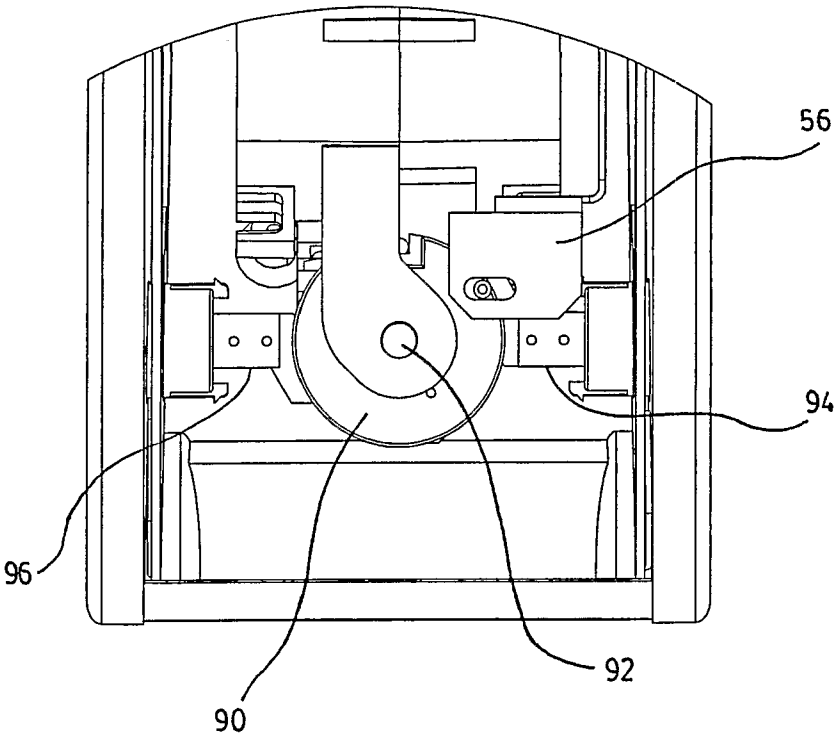
FIG. 18 is a partial rear view of internal elements of the childproof knife support of FIG. 16 in a second position.
Figure 17:
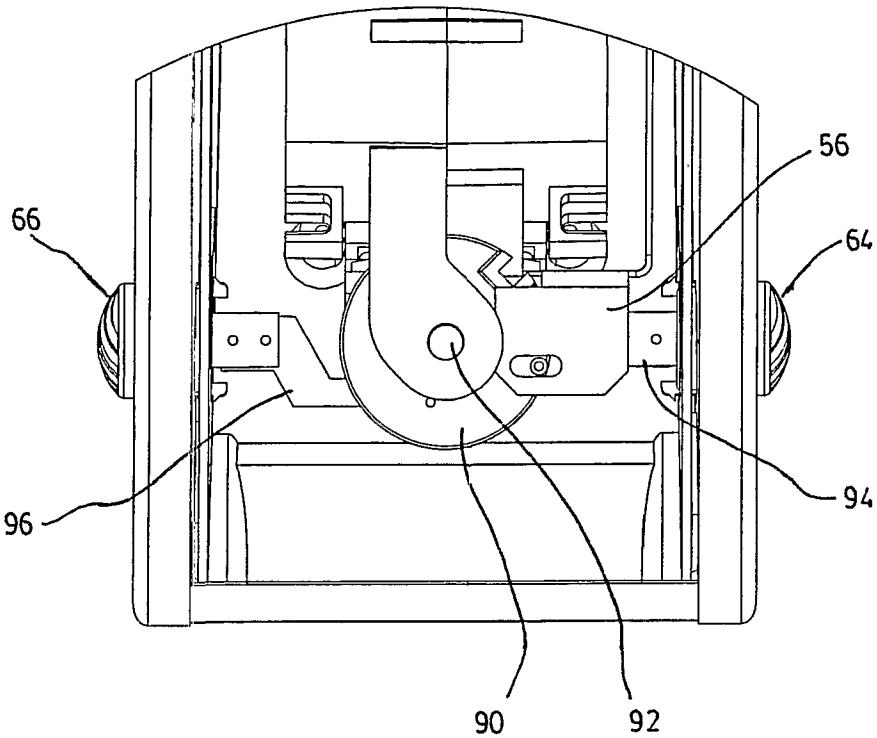
FIG. 17 is a partial rear view of internal elements of the childproof knife support of FIG. 16 in a first position.
Figure 19:
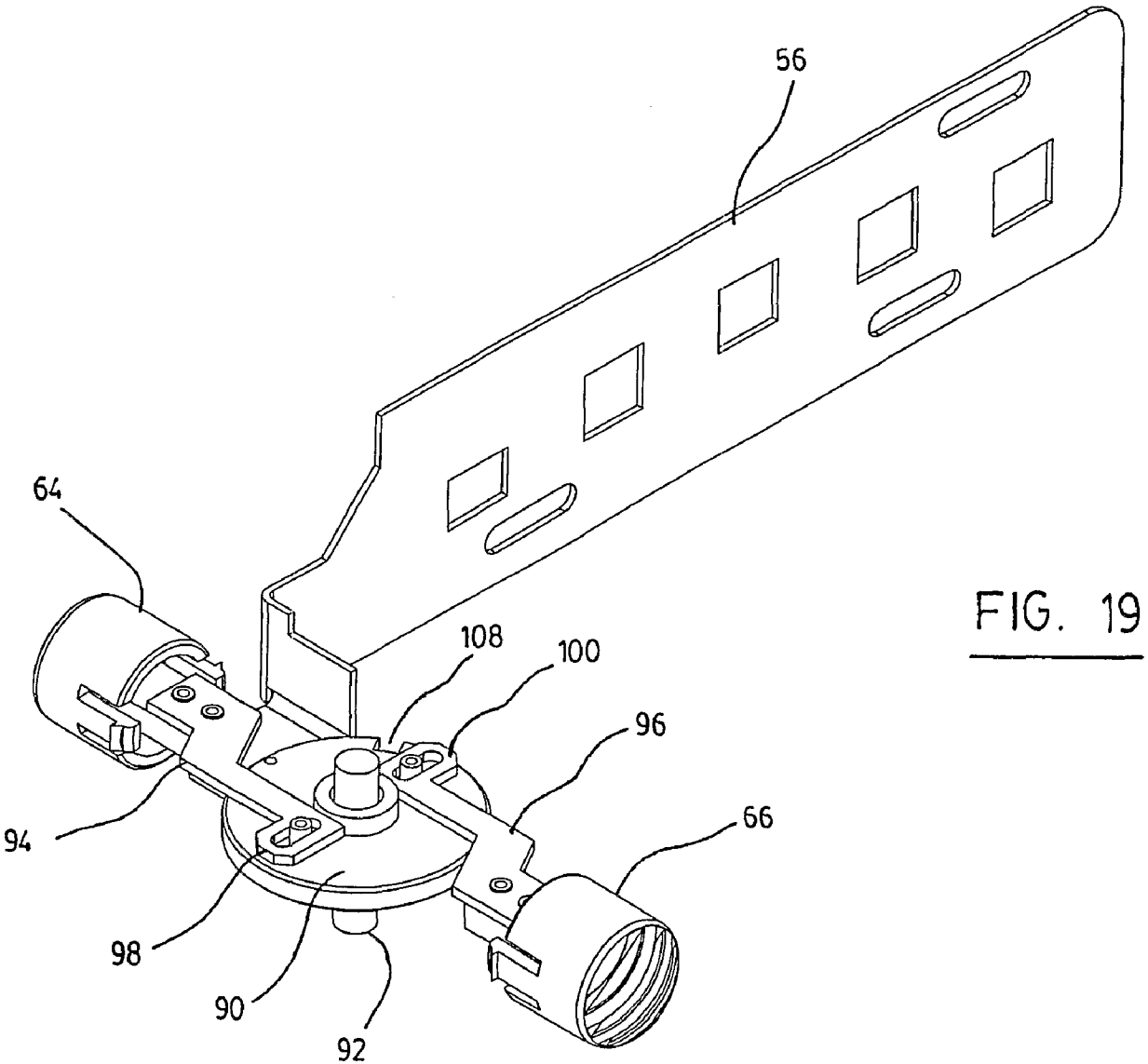
FIG. 19 is a perspective front view of elements shown partially in FIGS. 17 and 18.
Figure 20:
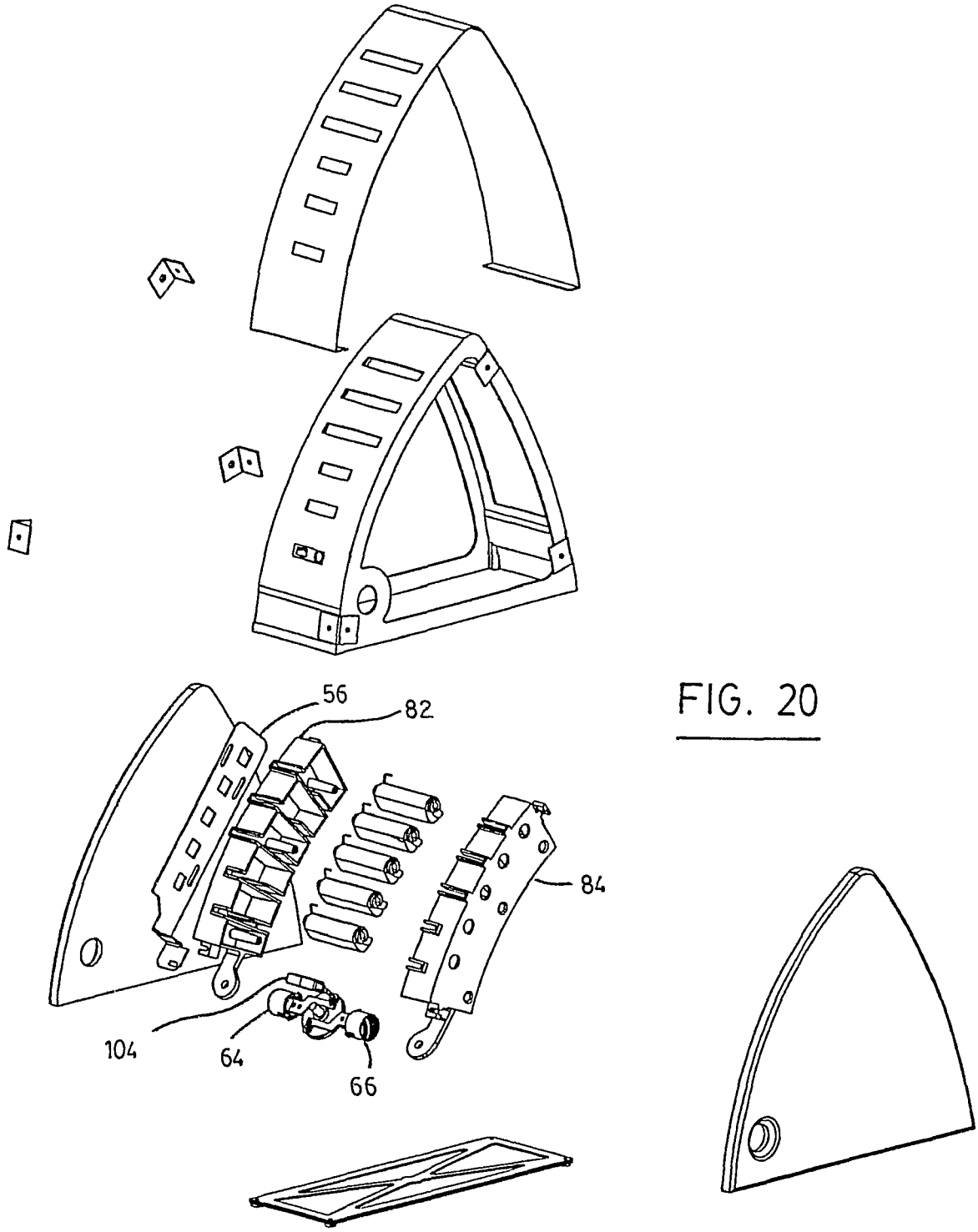
FIG. 20 is an exploded view of the embodiment of the childproof knife support shown in FIGS. 16 to 19.
Figure 21:
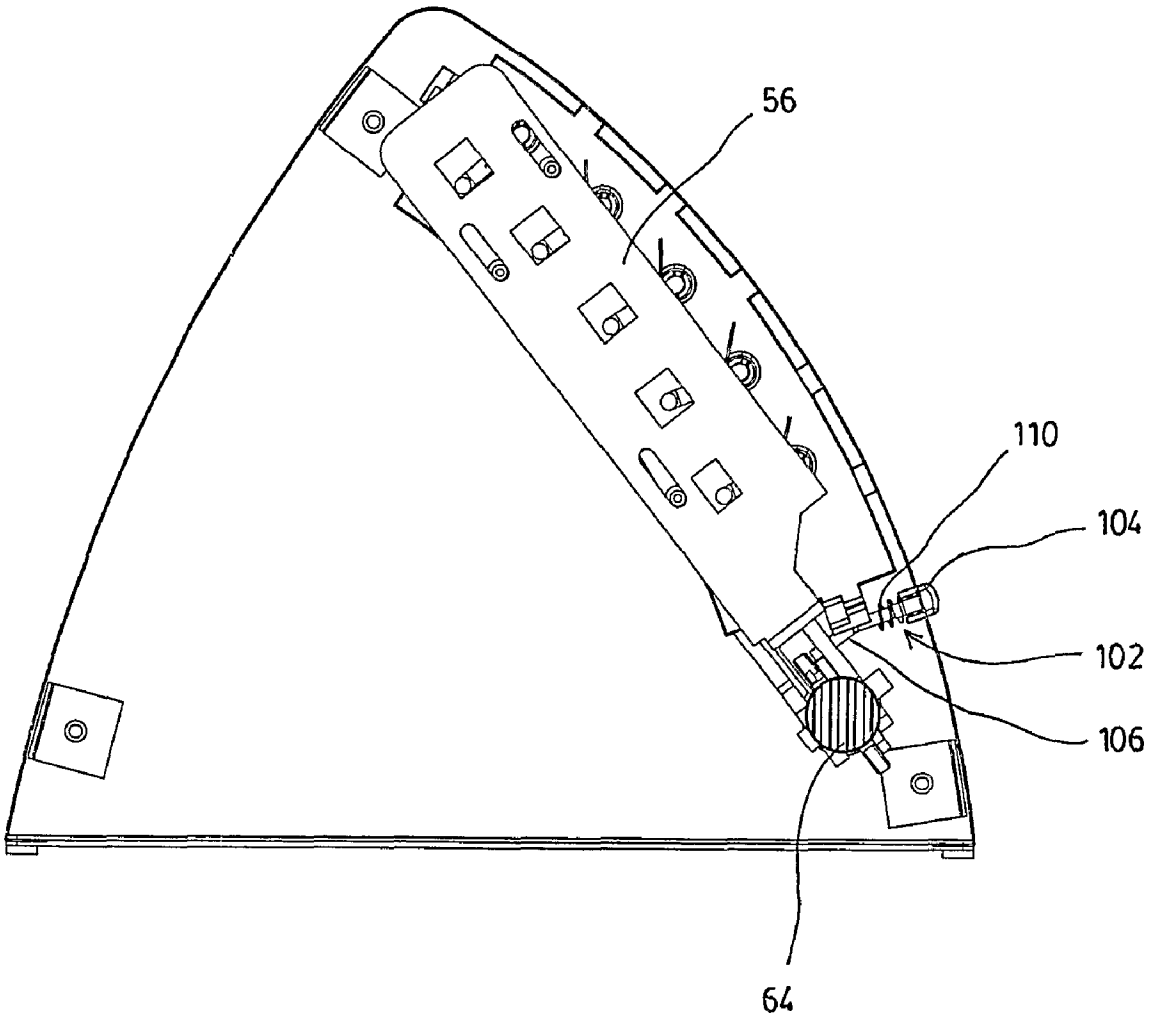
FIG. 21 is a side view of internal elements of the childproof knife support shown in FIGS. 16 and 17.
Figure 22:
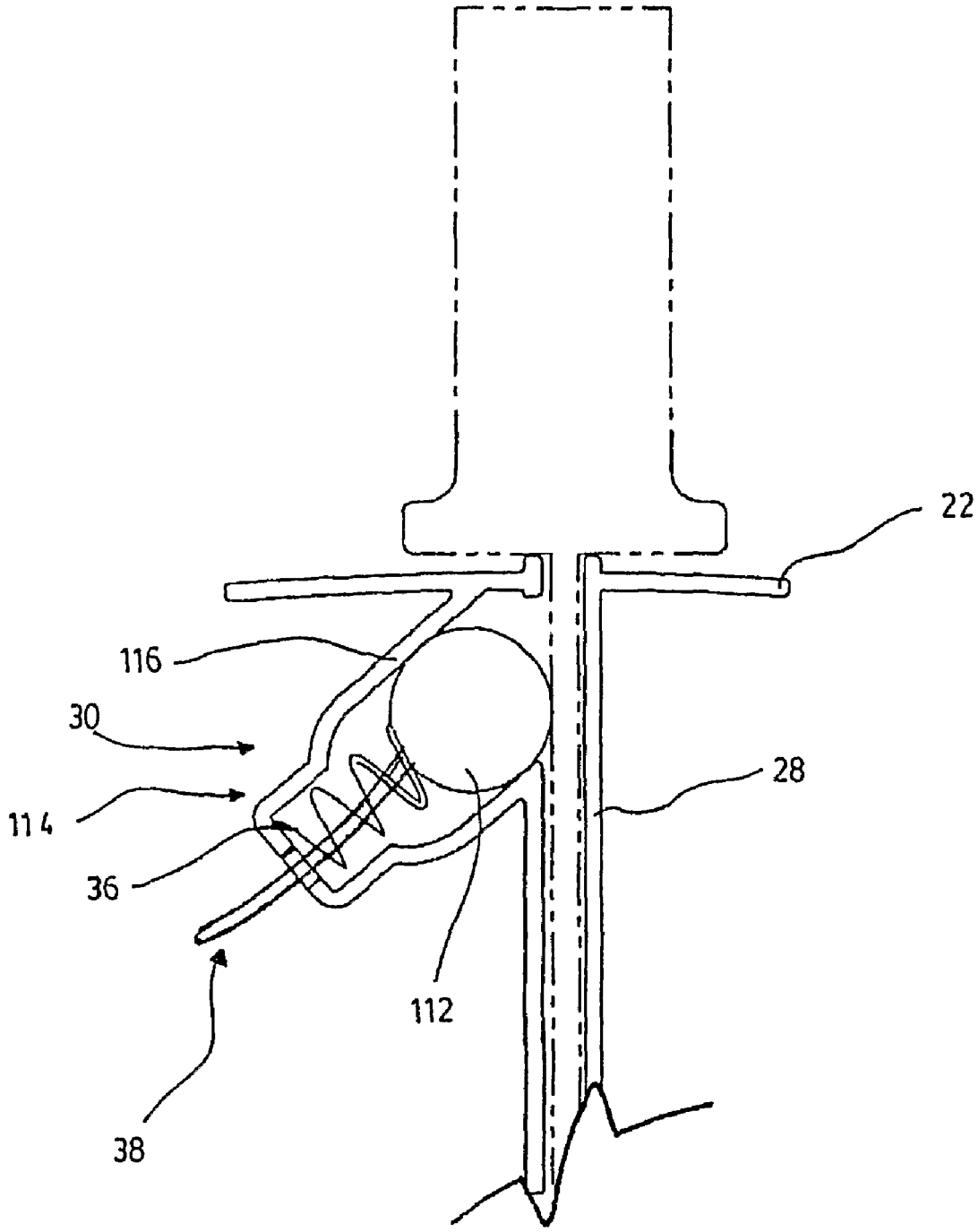
FIG. 22 is a partial cross sectional side view of another embodiment of the childproof knife support according to the present invention showing a knife inserted therein in dotted lines.
Figure 23A:
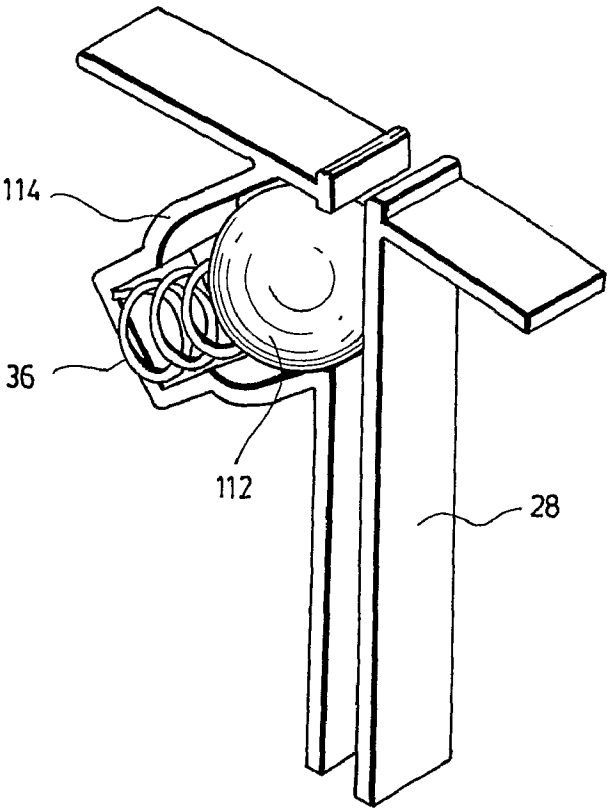
FIG. 23A is a perspective view of internal elements of the childproof knife support of FIG. 22 in a first position.
Figure 23B:
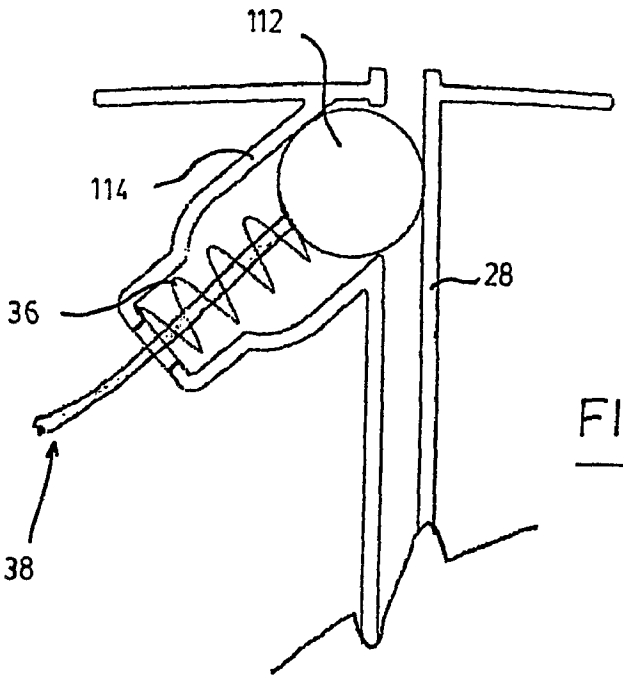
FIG. 23B is a side view of internal elements of the childproof knife support of FIG. 23A.
Figure 23C:
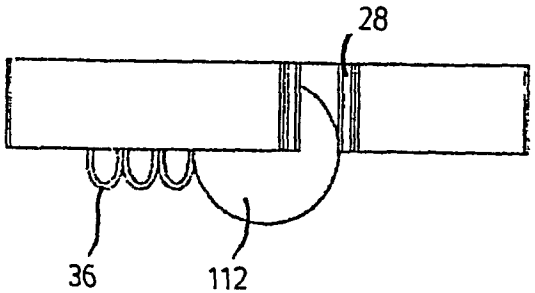
FIG. 23C is a top view of internal elements of the childproof knife support of FIG. 23A.
Figure 24A:
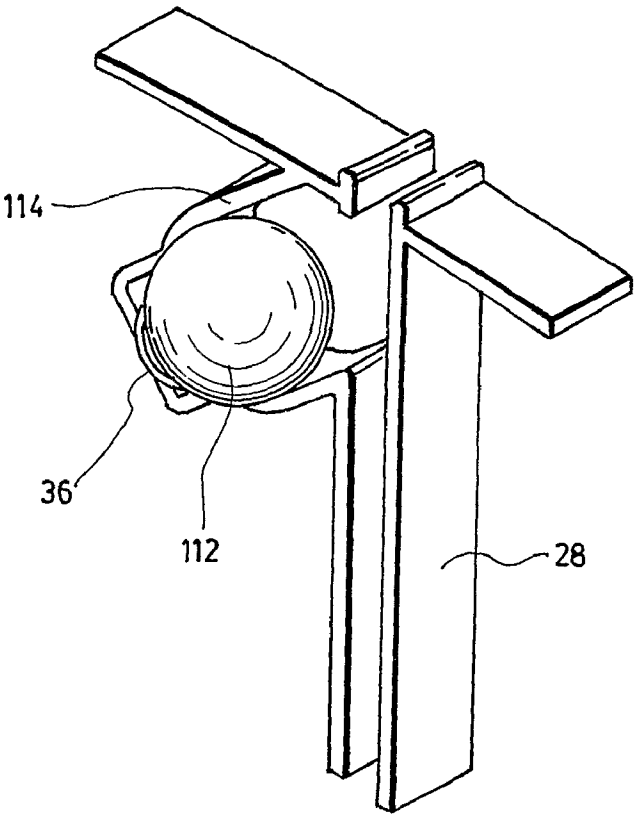
FIG. 24A is a perspective view of internal elements of the childproof knife support of FIG. 22 in a second position.
Figure 24C:
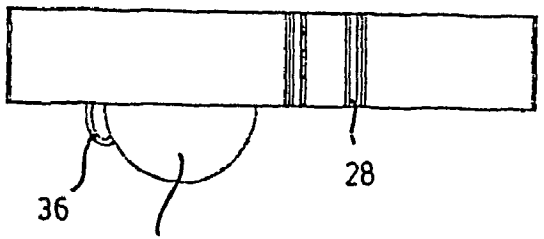
FIG. 24C is a top view of internal elements of the childproof knife support of FIG. 24A.
Figure 24B:
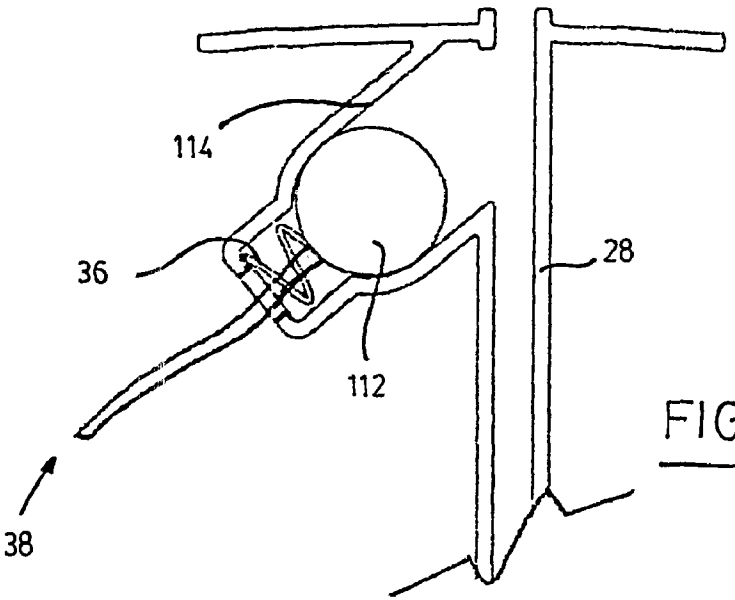
FIG. 24B is a side view of internal elements of the childproof knife support of FIG. 24A.

Referring now to FIGS. 16 to 21, there is shown another preferred embodiment of the childproof knife support of the present invention. In this embodiment, the moving mechanism comprises a disk 90 rotable on an axis 92 solid with the casing 80 of the frame 22. The disk 90 is connected to the plate 56 so that the plate moves between first and second position by a rotation of the disk 90. The moving mechanism also comprises two opposite elements 94, 96 movable according to a translation movement. The opposite elements 94, 96 have push buttons 64, 66 on their ends, accessible to the user. The second ends 98, 100 of the opposite elements 94, 96 are connected to the disk 90. Thus, the user moves the plate 56 to its second position through the disk 90 by applying a pressure on the push buttons 64 and 66 and consequently the knives can be released. As long as the user applies a pressure on the buttons 64 and 66 the knives can be released. FIG. 17 shows the positions of the disk 90, the opposite elements 94, 96 and the buttons 64, 66 when the plate 56 is in its first position. FIG. 18 shows them when the plate 56 is in its second position where the knives can be released.

The childproof knife support may advantageously further comprise a latching mechanism 102 mounted on the frame 22 for locking the disk 90. When the disk 90 is locked, the plate 56 is also locked in its second position where the knives can be released. The locking of the disk 90 occurs when the plate 56 is in the second position and the user applies a pressure on the latching button 104 which drives an element 106 of the latching mechanism 102 into an aperture 108 provided in the disk 90.

To release the second position, and consequently lock the knives in the knife support, the user has to press the buttons 64, 66. Then, a spring 110 will push back the latching button 104 in its original position and reactivate the locking mechanism.

Referring now to FIGS. 22 to 24C, another preferred embodiment of the childproof knife support of the present invention will now be described. In this embodiment, the second jaw 30 is preferably provided with a ball 112, preferably a rubber ball, and a guiding element 114 receiving the ball therein. The guiding element 114 is preferably mounted in a fixed manner with respect to the frame 22 for guiding, with the aid of the spring 36, the ball 112 against the first jaw 28. Preferably, the guiding element 114 has a guiding channel 116, the spring 36 extending therein for urging the ball 112 against the first jaw 28. In this embodiment, the releasing mechanism 38 may be a pulling device adapted to pull the ball 112 against the action of the spring 36, thereby allowing to remove the knife from the support 20, but, of course, any other convenient means could also be envisaged.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A childproof knife support for supporting at least one knife provided with a blade, said knife support comprising:

a frame having a hole extending therein for receiving the blade of the knife;

a clamp mounted in the hole and having first and second adjacent jaws for clamping the blade inside the frame once the blade is introduced in the hole, the first jaw being mounted in a fixed manner in the hole and the second jaw being movably mounted with respect to the frame the second jaw being pivotally mounted on a pivot axis with respect to the frame and having an eccentric portion;

a spring for urging the second jaw against the first jaw to prevent a movement of the blade away from the hole by clamping the blade; and a releasing mechanism preventing an action of the spring on the second jaw, thereby allowing said movement of the blade away from the hole.

2. The childproof knife support according to claim 1, wherein said second jaw comprises a rubber portion.

3. The childproof knife support according to claim 2, wherein said rubber portion is a rubber extrusion.

4. The childproof knife support according to claim 2, wherein said rubber portion is over-molded.

5. The childproof knife support according to claim 2, wherein said rubber portion is co-injected.

6. The childproof knife support according to claim 2, wherein said rubber portion is mechanically attached to the second jaw.

7. The childproof knife support according to claim 2, wherein said rubber portion is chemically attached to the second jaw.

8. The childproof knife support according to claim 1, wherein said eccentric portion has a rounded shape.

9. The childproof knife support according to claim 8, wherein said eccentric portion comprises an over-molded rubber portion.

10. The childproof knife support according to claim 1, wherein the pivot axis is off-centered in opposite direction with respect to the eccentric portion.

11. The childproof knife support according to claim 1, further comprising a shaped rod having a first end extending inside the second jaw along said pivot axis, and a second shaped end protruding from said second jaw, said rod being solid with the second jaw, said spring being a torsion spring mounted between the frame and the second end of the rod for urging the second jaw against the first jaw, said releasing mechanism comprising:

a plate slidably mounted to the frame and having an aperture for receiving said second end of said rod therethrough, said plate being slidable between a first position where the second end of said rod is able to move freely within the aperture of the plate, and a second position where the second end is moved against the action of the torsion spring, thereby allowing said movement of the blade away from the hole of the frame;

a locking mechanism operatively connected to the plate for locking said plate in said first position, said locking mechanism being accessible to a user to unlock said plate; and a moving mechanism operatively connected to the plate, said moving mechanism being accessible to a user for sliding said plate in said second position when said locking mechanism is unlocked.

12. The childproof knife support according to claim 11, wherein said eccentric portion has a rounded shape and comprises a rubber portion.

13. The childproof knife support according to claim 11, wherein the pivot axis is off-centered in opposite direction with respect to the eccentric portion.

14. The childproof knife support according to claim 11, wherein said locking mechanism comprises a first and a second push button extending on the frame and interconnected together through a locking element interacting with the plate, an action of said user on each of said push buttons unlocking said plate from said locking element.

15. The childproof knife support according to claim 14, wherein said moving mechanism comprises a sliding button extending on the frame distal from said push buttons, said moving mechanism further comprising a swivel connected to each of the sliding button and the plate for sliding said plate.

16. The childproof knife support according to claim 11, wherein said frame further has a plurality of holes extending therein, each for respectively receiving the blade of a corresponding knife, said support further comprising:

a plurality of clamps, each being respectively mounted in a corresponding hole;

a plurality of springs for respectively urging the corresponding second jaw of the corresponding clamp against the corresponding first jaw; and a plurality of shaped rods, each being solid with the corresponding second jaw of the corresponding clamp;

and wherein said plate of said releasing mechanism has a plurality of apertures for respectively receiving the corresponding second end of the corresponding rod therethrough to allow the releasing mechanism to prevent the action of each of said springs on the corresponding second jaw.

17. The childproof knife support according to claim 16, wherein said locking mechanism comprises a first and a second push button extending on the frame and interconnected together through a locking element interacting with the plate, an action of said user on each of said push buttons unlocking said plate from said locking element.

18. The childproof knife support according to claim 16, wherein said moving mechanism comprises a sliding button extending on the frame distal from said push buttons, said moving mechanism further comprising a swivel connected to each of the sliding button and the plate for sliding said plate.

19. The childproof knife support according to claim 1, further comprising a shaped rod having a first end extending inside the second jaw along said pivot axis, and a second shaped end protruding from said second jaw, said rod being solid with the second jaw, said spring being a torsion spring mounted between the frame and the second end of the rod for urging the second jaw against the first jaw, said releasing mechanism comprising:

a plate slidably mounted to the frame and having an aperture for receiving said second end of said rod therethrough, said plate being slidable between a first position where the second end of said rod is able to move freely within the aperture of the plate, and a second position where the second end is moved against the action of the torsion spring thereby allowing said movement of the blade away from the hole of the frame;

a moving mechanism operatively connected to the plate, said moving mechanism being accessible to a user for sliding said plate in said second position.

20. The childproof knife support according to claim 19, wherein said eccentric portion has a rounded shape and comprises a rubber portion.

21. The childproof knife support according to claim 19, wherein the pivot axis is off-centered in opposite direction with respect to the eccentric portion.

22. The childproof knife support according to claim 19, wherein said moving mechanism comprises:

a disk rotatable on an axis solid with the frame, the disk being connected to the plate so that the plate moves between first and second position by a rotation of the disk; and two opposite elements movable according to a translation movement, these opposite elements having first ends accessible to the user and second ends connected to the disk so that the user moves the plate through the disk by applying a pressure on the first ends of the opposite elements.

23. The childproof knife support according to claim 22, comprising a latching mechanism mounted on the frame for locking the disk and consequently the plate in the second position by cooperating with an aperture provided in the disk when the plate is in the second position.

24. The childproof knife support according to claim 19, wherein said frame further has a plurality of holes extending therein, each for respectively receiving the blade of a corresponding knife, said support further comprising:

a plurality of clamps, each being respectively mounted in a corresponding hole;

a plurality of springs for respectively urging the corresponding second jaw of the corresponding clamp against the corresponding first jaw; and a plurality of shaped rods, each being solid with the corresponding second jaw of the corresponding clamp;

and wherein said plate of said releasing mechanism has a plurality of apertures for respectively receiving the corresponding second end of the corresponding rod therethrough to allow the releasing mechanism to prevent the action of each of said springs on the corresponding second jaw.

25. The childproof knife support according to claim 1, wherein said first jaw comprises a rubber wall.

26. A childproof knife support for supporting at least one knife provided with a blade, said knife support comprising:

a frame having a hole extending therein for receiving the blade of the knife;

a clamp mounted in the hole and having first and second adjacent jaws for clamping the blade inside the frame once the blade is introduced in the hole, the first jaw being mounted in a fixed manner in the hole and the second jaw being movably mounted with respect to the frame, the second jaw comprising a ball and a guiding element receiving the ball therein, the guiding element being mounted in a fixed manner with respect to the frame for guiding, with the aid of the spring, the ball against the first jaw;

a spring for urging the second jaw against the first jaw to prevent a movement of the blade away from the hole by clamping the blade; and a releasing mechanism preventing an action of the spring on the second jaw, thereby allowing said movement of the blade away from the hole.

27. The childproof knife support according to claim 26, wherein said ball is a rubber ball.

28. The childproof knife support according to claim 26, wherein said guiding element comprises a guiding channel, the spring extending therein.

* * * * *

UNITED STATES PATENT AND TRADEMARK OFFICE

CERTIFICATE OF CORRECTION

PATENT NO. : 7,631,772 B2
APPLICATION NO. : 12/091955
DATED : December 15, 2009
INVENTOR(S) : Andre Lafleur It is certified that error appears in the above-identified patent and that said Letters Patent is hereby corrected as shown below:

On the Title Pg Item (73)

Under "Assignee", please correct as follows:

-- Les Promotions Atlantiques Inc./Atlantic Promotions Inc. --

Signed and Sealed this

Second Day of February, 2010

David J. Kappos

David J. Kappos
*Director of the United States Patent and Trademark Office*